US007862029B2

(12) United States Patent
Yokobori et al.

(10) Patent No.: US 7,862,029 B2
(45) Date of Patent: Jan. 4, 2011

(54) IMAGE FORMING SYSTEM, IMAGE FORMING DEVICE, POST-PROCESSOR, AND PROGRAM

(75) Inventors: Jun Yokobori, Tokyo (JP); Takao Kurohata, Tokyo (JP); Shoichi Nakamura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/167,440

(22) Filed: Jul. 3, 2008

(65) Prior Publication Data

US 2008/0273884 A1 Nov. 6, 2008

Related U.S. Application Data

(62) Division of application No. 11/290,849, filed on Nov. 30, 2005, now Pat. No. 7,547,010.

(30) Foreign Application Priority Data

Dec. 6, 2004 (JP) ..... 2004-352923
Sep. 15, 2005 (JP) ..... 2005-268281

(51) Int. Cl.
*B65H 85/00* (2006.01)

(52) U.S. Cl. ..... 271/3.14; 271/258.01; 399/21; 399/382; 700/213

(58) Field of Classification Search ..... 700/213, 700/219, 223; 271/9.01, 9.05, 3.14, 258.01, 271/176; 399/21, 382
See application file for complete search history.

(56) References Cited

U.S. PATENT DOCUMENTS 3,951,264 A * 4/1976 Heidecker et al. ..... 206/308.3
5,596,389 A * 1/1997 Dumas et al. ..... 399/16
5,839,045 A * 11/1998 Wierszewski ..... 399/382
6,904,261 B2 * 6/2005 Fujii et al. ..... 399/382
2004/0022564 A1 * 2/2004 Fujii et al. ..... 399/382

FOREIGN PATENT DOCUMENTS

JP 2728812 12/1997

* cited by examiner

*Primary Examiner*—David H Bollinger
(74) *Attorney, Agent, or Firm*—Cantor Colburn LLP

(57) ABSTRACT

An image forming system includes an input unit for input of setting information, an image forming unit, a conveying unit, a control unit, and a jam detecting unit, wherein a set of a plurality of different kinds of special sheets disposed in a predetermined order is used. When occurrence of a jam is detected by the jam detecting unit, the control unit recognizes whether a special sheet having been fed is present in the image forming system, and if it is recognized that a special sheet is present in the image forming system, the control unit controls the conveying unit, after the jam being released, to eject a special sheet or sheets as unnecessary up to one that is disposed preceding a special sheet that is of the same kind as a most front one that was present in the image forming system at the time of the occurrence of the jam.

8 Claims, 15 Drawing Sheets

IMAGE FORMING SYSTEM, IMAGE FORMING DEVICE, POST-PROCESSOR, AND PROGRAM

CROSS REFERENCE TO RELATED APPLICATIONS

The present application is a divisional application of U.S. patent application Ser. No. 11/290,849 filed Nov. 30, 2005, the entire contents of which are incorporated herein by reference and priority to which is claimed herein. The Ser. No. 11/290,849 application claimed benefit of the date of the earlier filed Japanese Patent Applications No. 2004-352923 filed Dec. 6, 2004 and No. 2005-268281 filed Sep. 15, 2005, both of which are incorporated herein by reference, and priority to all of which is also claimed herein.

FIELD OF THE INVENTION

The present invention relates to an image forming system, image forming device, post-processor, and program which use a special sheet set of a plurality of different kinds of special sheets that are disposed in a predetermined order are disposed in a predetermined order.

BACKGROUND OF THE INVENTION

Conventionally, for an image forming device, such as a copier and printer, there is known a technology which uses a special sheet set of a plurality of different kinds of special sheets that are disposed in a predetermined order, such as tab sheets having different tab positions or color sheets in a series of different colors, are disposed in a predetermined order, and performs printing while inserting special sheets at predetermined pages during printing. In performing printing by the use of such a special sheet set, it is required to perform printing while inserting right sheets at right positions.

In printing by the use of a special sheet set, if the quantity of special sheets used for printing one copy is not an integer multiple of the quantity of special sheets per set, unnecessary special sheet/sheets are left each time printing for one copy is completed. For example, using a tab sheet set of five tab sheets with respective different tabs, as shown in FIG. 9 (*a*), and setting the insertion positions of tab sheets for each copy to be "front cover sheet/back cover sheet/after the second page", when printing of one copy is performed, tab sheets up to the third tab are used. If printing is performed for the second copy following this, there is a problem that the tab sheet with the fourth tab is inserted as the front cover sheet, as shown in FIG. 9 (*b*).

To solve such a problem, for example, in Patent Document 1, a technology is disclosed by which, in a case where the quantity of tabs used for one print copy is not an integer multiple of the quantity of tab positions, sheets with an unnecessary tab are ejected, not to be used, from a system so that printing for the next print copy is performed on right sheets.

For example, as shown in FIG. 10, in a case where a tab sheet set of five tab sheets with respective different tab positions and printing is performed in such a manner that the insertion positions of tab sheets in each copy are set as "front cover sheet/back cover sheet/after the second page", after completion of printing for one copy, two unnecessary tab sheets which respectively have the fourth tab and the fifth tab are ejected, and thus tab sheets are correctly inserted also in printing the next copy.

[Patent Document 1] Patent No. 2728812

However, during performing printing by an image forming device, using a special sheet set, as described above, there have been a problem that a paper jam may occur and the order of special sheets is shifted in printing after releasing the jam. Further, also in a case where a jam occurs during ejection of special sheets, which have become unnecessary, there has been a problem that special sheets are ejected more than required for ejection, by which the order of special sheets is shifted.

SUMMARY OF THE INVENTION

An object of the invention is to prevent a shift of the order of special sheets to be fed after releasing a jam, in a case where the jam has occurred during printing by the use of a special sheet set arranged by disposing, in a predetermined order, a plurality of special sheets of kinds which are different to each other.

To solve such problems, the invention includes the following structures.

An image forming system comprising: an input unit for input of setting information including a quantity of special sheets per set and an insertion position of each special sheet for a copy, wherein a set of a plurality of different kinds of special sheets are disposed in a predetermined order; an image forming unit that forms an image on a recording sheet or on a special sheet, based on inputted image data; a conveying unit that feeds a recording sheet from a recording sheet feeding tray or a special sheet from a special sheet feeding tray, conveys the fed recording sheet or the special sheet along a conveying path, and ejects the fed recording sheet or special sheet to an ejection tray; a control unit which controls the image forming unit and the conveying unit to feed a recording sheet or a special sheet, based on setting information inputted from the input unit, to form an image at least on the fed recording sheet, and to eject the fed recording sheet or the special sheet; and a jam detecting unit which detects occurrence of a jam in the image forming system, wherein when occurrence of a jam is detected by the jam detecting unit, the control unit recognizes whether one or more special sheets which have been fed are present in the image forming system, and if it is recognized that one or more special sheets are present in the image forming system, the control unit controls the conveying unit, after the jam being released, to eject a special sheet or sheets as unnecessary up to one that is on the special sheet feeding tray and disposed preceding a special sheet that is of the same kind as a most front one that was present in the image forming system at the time of the occurrence of the jam.

An image forming system comprising: an input unit for input of setting information including a quantity of special sheets per set and an insertion position of each special sheet for a copy, wherein a set of a plurality of different kinds of special sheets are disposed in a predetermined order; an image forming unit that forms an image on a recording sheet or on a special sheet, based on inputted image data; a conveying unit that feeds a recording sheet from a recording sheet feeding tray or a special sheet from a special sheet feeding tray, conveys the fed recording sheet or the special sheet along a conveying path, and ejects the fed recording sheet or special sheet to an ejection tray; a control unit which controls the image forming unit and the conveying unit to feed a recording sheet or a special sheet, based on setting information inputted from the input unit, to form an image at least on the fed recording sheet, and to eject the fed recording sheet or the special sheet; and a jam detecting unit which detects occurrence of a jam in the image forming system, wherein if a quantity of special sheet or sheets to be used for one copy is not an integer multiple of the quantity of special sheets per set, the control unit controls the conveying unit to eject an unnecessary special sheet or sheets each time image forming and ejection for one copy are completed, and when occurrence of a jam is detected by the jam detecting unit during ejection of the unnecessary sheet or sheets and if one or more special sheets having been fed are present in the image forming system, the control unit obtains a quantity of the one or more special sheets, and controls the conveying unit, after the jam being released, to eject a special sheet or sheets in a remaining quantity calculated by subtraction of the obtained quantity of the one or more special sheets from the quantity of the unnecessary sheet or sheets to be ejected.

A program to make a computer realize a function, the computer controlling an image forming system which uses a set of a plurality of different kinds of special sheets that are disposed in a predetermined order, feeds a recording sheet or special sheet in a predetermined order, forms an image at least on the recording sheet having been fed, based on inputted image data, and ejects the fed recording sheet or special sheet, the function comprising: when occurrence of a jam is detected, recognizing whether one or more special sheets having been fed are present in the image forming system; and if it is recognized that one or more special sheets are present in the image forming system, performing control, after the jam being released, to eject a special sheet or sheets as unnecessary up to one that is on a special sheet feeding tray and disposed preceding a special sheet that is of the same kind as a most front one that was present in the image forming system at the time of the occurrence of the jam.

A program to make a computer realize a function, the computer controlling an image forming system which uses a set of a plurality of different kinds of special sheets that are disposed in a predetermined order, feeds a recording sheet or special sheet in a predetermined order, forms an image at least on the recording sheet having been fed, based on inputted image data, and ejects the fed recording sheet or special sheet, the function comprising: if a quantity of special sheet or sheets to be used for one copy is not an integer multiple of the quantity of special sheets per set, performing control to eject an unnecessary special sheet or sheets each time image forming and ejection for one copy are completed; when occurrence of a jam is detected during ejection of the unnecessary sheet or sheets and if one or more special sheets having been fed are present in the image forming system, obtaining a quantity of the one or more special sheets; and after the jam being released, performing control to eject a special sheet or sheets in a remaining quantity calculated by subtraction of the obtained quantity of the one or more special sheets from the quantity of the unnecessary sheet or sheets to be ejected.

An image forming system comprising: an input unit for input of setting information including a quantity of special sheets per set and an insertion position of each special sheet for a copy, wherein a set of a plurality of different kinds of special sheets are disposed in a predetermined order; an image forming unit that forms an image on a recording sheet or on a special sheet, based on inputted image data; a conveying unit that feeds a recording sheet from a recording sheet feeding tray or a special sheet from a special sheet feeding tray, conveys the fed recording sheet or the special sheet along a conveying path, and ejects the fed recording sheet or special sheet to an ejection tray; a control unit which controls the image forming unit and the conveying unit to feed a recording sheet or a special sheet, based on setting information inputted from the input unit, to form an image at least on the fed recording sheet, and to eject the fed recording sheet or the special sheet; a jam detecting unit which detects occurrence of a jam in the image forming system; and a stacking unit which is provided in the conveying path to stack a recording sheet or special sheet having been conveyed by the conveying unit, for post processing, wherein when occurrence of a jam is detected by the jam detecting unit, the control unit recognizes whether one or more special sheets which have been fed are present at a place other than the stacking unit in the image forming system, and if it is recognized that one or more special sheets are present at the place other than the stacking unit, the control unit controls the conveying unit, after the jam being released, to eject a special sheet or sheets as unnecessary up to one that is on the special sheet feeding tray and disposed preceding a special sheet that is of the same kind as a most front one that was present at the place other than the stacking unit at the time of the occurrence of the jam.

An image forming system comprising: an input unit for input of setting information including a quantity of special sheets per set and an insertion position of each special sheet for a copy, wherein a set of a plurality of different kinds of special sheets are disposed in a predetermined order; an image forming unit that forms an image on a recording sheet or on a special sheet, based on inputted image data; a conveying unit that feeds a recording sheet from a recording sheet feeding tray or a special sheet from a special sheet feeding tray, conveys the fed recording sheet or the special sheet along a conveying path, and ejects the fed recording sheet or special sheet to an ejection tray; a control unit which controls the image forming unit and the conveying unit to feed a recording sheet or a special sheet, based on setting information inputted from the input unit, to form an image at least on the fed recording sheet, and to eject the fed recording sheet or the special sheet; a jam detecting unit which detects occurrence of a jam in the image forming system; and a stacking unit which is provided in the conveying path to stack a recording sheet or special sheet having been conveyed by the conveying unit, for post processing, wherein if a quantity of special sheet or sheets to be used for one copy is not an integer multiple of the quantity of special sheets per set, the control unit controls the conveying unit to eject an unnecessary special sheet or sheets each time image forming and ejection for one copy are completed, and when occurrence of a jam is detected by the jam detecting unit during ejection of the unnecessary sheet or sheets and if one or more special sheets having been fed are present at a place other than the stacking unit in the image forming system, the control unit obtains a quantity of the one or more special sheets, and controls the conveying unit, after the jam being released, to eject a special sheet or sheets in a remaining quantity calculated by subtraction of the obtained quantity of the one or more special sheets from the quantity of the unnecessary sheet or sheets to be ejected.

A program make a computer realize a function, the computer controlling an image forming system which uses a set of a plurality of different kinds of special sheets that are disposed in a predetermined order, feeds and conveys a recording sheet or special sheet in a predetermined order, forms an image at least on the recording sheet having been fed, based on inputted image data, stacks the conveyed recording sheet or special sheet onto a stacking unit for post-processing, performs post-processing when a recording sheet or sheets and a special sheet or sheets for one copy have been stacked, and ejects the sheets, the function comprising: when occurrence of a jam is detected, recognizing whether one or more special sheets which have been fed are present at a place other than the stacking unit in the image forming system; and if it is recognized that one or more special sheets are present at a place other than the stacking unit, performing control, after the jam being released, to eject a special sheet or sheets as unnecessary up to one that is on a special sheet feeding tray and disposed preceding a special sheet that is of the same kind as a most front one that was present at the place other than the stacking unit at the time of the occurrence of the jam.

A program to make a computer realize a function, the computer controlling an image forming system which uses a special sheet set of a plurality of different kinds of special sheets that are disposed in a predetermined order, feeds and conveys a recording sheet or special sheet in a predetermined order, forms an image at least on the recording sheet having been fed, based on inputted image data, stacks the conveyed recording sheet or special sheet onto a stacking unit for post-processing, performs post-processing when a recording sheet or sheets and a special sheet or sheets for one copy have been stacked, and ejects the sheets, the function comprising: if a quantity of a special sheet or sheets to be used for one copy is not an integer multiple of a quantity of special sheets per set, performing control to eject an unnecessary special sheet or sheets each time image forming and ejection for one copy are completed; and when occurrence of a jam is detected during ejection of the unnecessary sheet or sheets and if one or more special sheets having been fed are present at a place other than the stacking unit in the image forming system, obtaining a quantity of the one or more special sheets and performing control, after the jam being released, to eject a special sheet or sheets in a remaining quantity calculated by subtraction of the obtained quantity of the one or more special sheets from the quantity of the unnecessary sheet or sheets to be ejected.

An image forming device connectable to a post-processor having a special sheet feeding tray to mount a set of a plurality of different kinds of special sheets that are disposed in a predetermined order, and an ejection tray to eject a recording sheet on which an image has been formed or a special sheet fed from the special sheet feeding tray, the image forming device comprising: an input unit for input of setting information including a quantity of special sheets per set and an insertion position of each special sheet for a copy; an image forming unit which forms an image on a recording sheet, based on inputted image data; a feed-out unit which feeds out a recording sheet on which an image has been formed by the image forming unit to the post-processor; and a control unit to control the post-processor to eject a recording sheet to the ejection tray, the recording sheet having been fed out from the image forming unit to the post-processor, and to feed a special sheet from the special sheet feeding tray and eject it to the ejection tray, according to inputted setting information, wherein, when jam detection information is input from the post-processor and if one or more special sheets having been fed are present in the post-processor, the control unit obtains, from the post-processor, a quantity of the one or more special sheets, and after the jam being released, the control unit controls the post-processor to feed, from the special sheet feeding tray, and eject a special sheet or sheets as unnecessary up to one that is disposed preceding a special sheet that is of the same kind as a most front one that was present in the post-processor at the time of the occurrence of the jam.

An image forming device connectable to a post-processor having a special sheet feeding tray to mount a set of a plurality of different kinds of special sheets that are disposed in a predetermined order, and an ejection tray to eject a recording sheet on which an image has been formed or a special sheet fed from the special sheet feeding tray, the image forming device comprising: an input unit for input of setting information including a quantity of special sheets per set and an insertion position of each special sheet for a copy; an image forming unit which forms an image on a recording sheet, based on inputted image data; a feed-out unit which feeds out a recording sheet on which an image has been formed by the image forming unit to the post-processor; and a control unit to control the post-processor to eject a recording sheet to the ejection tray, the recording sheet having been fed out from the image forming unit to the post-processor, and to feed a special sheet from the special sheet feeding tray and eject it to the ejection tray, according to inputted setting information, and to eject an unnecessary special sheet or sheets each time ejection of a recording sheet or sheets and a special sheet or sheets for one copy is completed if a quantity of a special sheet or sheets to be used for one copy is not an integer multiple of the quantity of special sheets per set, wherein when jam detection information is input from the post-processor during ejection of the unnecessary sheet or sheets and if one or more special sheets having been fed are present in the post-processor, the control unit obtains a quantity of the one or more special sheets and controls the post-processor, after the jam being released, to feed, from the special sheet feeding tray, and eject a special sheet or sheets in a remaining quantity calculated by subtraction of the obtained quantity of the one or more special sheets from the quantity of the unnecessary sheet or sheets to be ejected.

An image forming device connectable to a post-processor having a special sheet feeding tray to mount a set of a plurality of different kinds of special sheets that are disposed in a predetermined order, a stacking unit to stack, for post-processing, a recording sheet on which an image has been formed or a special sheet which has been fed from the special sheet feeding tray, and an ejection tray to eject the recording sheet or the special sheet, the image forming device comprising: an input unit for input of setting information including a quantity of special sheets per set and an insertion position of each special sheet for a copy; an image forming unit which forms an image on a recording sheet, based on inputted image data; a feed-out unit which feeds out a recording sheet on which an image has been formed by the image forming unit to the post-processor; and a control unit to control the post-processor to eject a recording sheet to the ejection tray through the stacking unit, the recording sheet having been fed out from the image forming unit to the post-processor, and to feed, from the special sheet feeding tray, and eject a special sheet or sheets to the ejection tray through the stacking unit, according to inputted information, wherein when jam detection information is input from the post-processor and if one or more special sheets having been fed are present at a place other than the stacking unit in the post-processor, the control unit obtains a quantity of the one or more special sheets and controls the post-processor, after the jam being released, to eject a special sheet or sheets as unnecessary up to one that is on the special sheet feeding tray and disposed preceding a special sheet that is of the same kind as a most front one that was present at the place other than the stacking unit at the time of the occurrence of the jam.

A post-processor connectable to an image forming device for forming an image on a recording sheet, comprising: a special sheet feeding tray to mount a set of a plurality of different kinds of special sheets that are disposed in a predetermined order; a conveying unit that ejects a recording sheet fed out from the image forming device to an ejection tray, and feeds a special sheet from the special sheet feeding tray and ejects the special sheet to the ejection tray, according to information inputted from the image forming device, the information indicating an insertion position of each special sheet; a jam detecting unit which detects occurrence of a jam in the post-processor; and a control unit that, when occurrence of a jam is detected by the jam detecting unit and if one or more special sheets having been fed are present in the post-processor, obtains a quantity of the one or more special sheets, and performs control, after the jam being released, to eject a special sheet or sheets as unnecessary up to one that is on the special sheet feeding tray and disposed preceding a special sheet that is of the same kind as a most front one that was present in the post-processor at the time of the occurrence of the jam.

A post-processor connectable to an image forming device for forming an image on a recording sheet, comprising: a special sheet feeding tray to mount a set of a plurality of different kinds of special sheets that are disposed in a predetermined order; a conveying unit that ejects a recording sheet fed out from the image forming device to an ejection tray, and feeds a special sheet from the special sheet feeding tray and ejects the special sheet to the ejection tray, according to information inputted from the image forming device, the information indicating an insertion position of each special sheet; an control unit to eject an unnecessary special sheet or sheets each time ejection of a recording sheet or sheets and a special sheet or sheets for one copy is completed if a quantity of a special sheet or sheets to be used for one copy is not an integer multiple of the quantity of special sheets per set; and a jam detecting unit for detecting occurrence of a jam in the post-processor, wherein when occurrence of a jam is detected during ejection of the unnecessary sheet or sheets and if one or more special sheets having been fed are present in the post-processor, the control unit obtains a quantity of the one or more special sheets, and after the jam being released, performs control to feed, from the special sheet feeding tray, and eject a special sheet or sheets in a remaining quantity calculated by subtraction of the obtained quantity of the one or more special sheets from the unnecessary sheet or sheets to be ejected.

A post-processor connectable to an image forming device for forming an image on a recording sheet, comprising: a special sheet feeding tray to mount a set of a plurality of different kinds of special sheets that are disposed in a predetermined order; a stacking unit provided in the post-processor to stack, for post-processing, a recording sheet on which an image has been formed or a special sheet which has been fed from the special sheet feeding tray; a conveying unit that ejects a recording sheet fed out from the image forming device to an ejection tray through the stacking unit, and feeds a special sheet or sheets from the special sheet feeding tray and ejects the special sheet or sheets to the ejection tray through the stacking unit, according to information inputted from the image forming device and indicating an insertion position of each special sheet; a jam detecting unit for detecting occurrence of a jam in the post-processor; and a control unit that, when occurrence of a jam is detected by the jam detecting unit and if one or more special sheets having been fed are present at a place other than the stacking unit in the post-processor, obtains a quantity of the one or more special sheets which are present at a place other then the stacking unit in the post-processor, and performs control, after the jam being released, to feed, from the special sheet feeding tray, and eject a special sheet or sheets as unnecessary up to one that is disposed preceding a special sheet that is of the same kind as a most front one that was present at the place other than the stacking unit at the time of the occurrence of the jam.

DETAILED DESCRIPTION OF PREFERRED EMBODIMENTS

Figure 1:
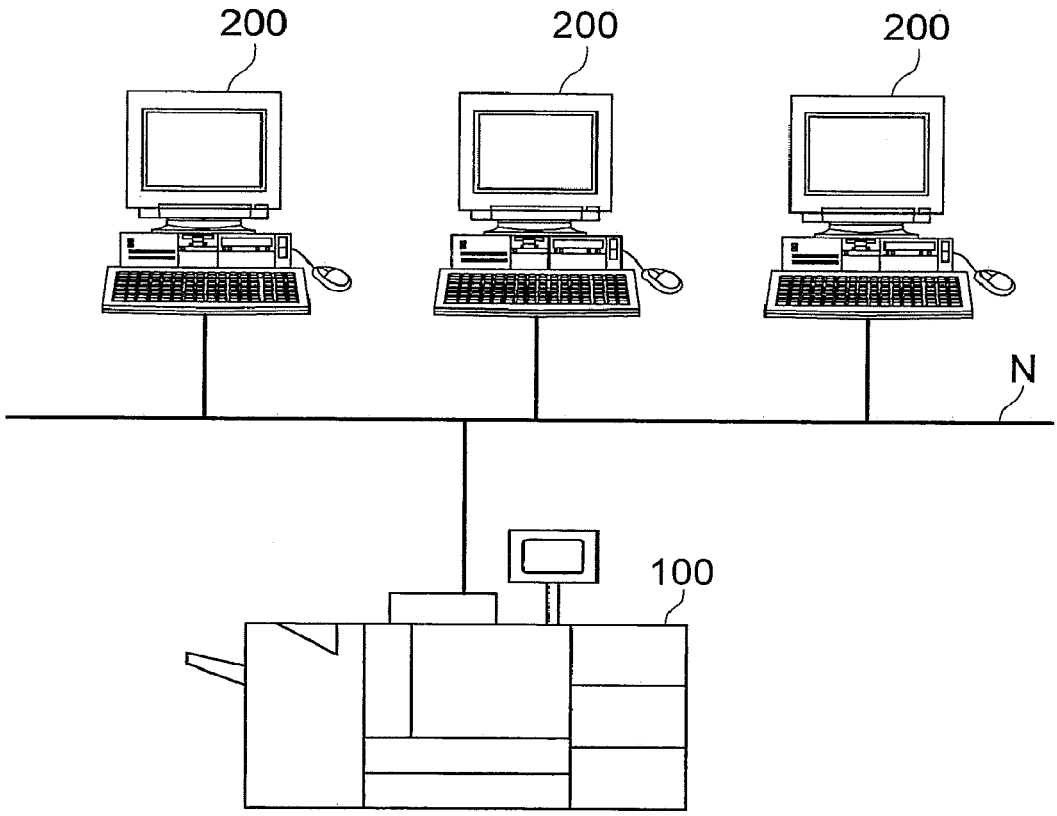
FIG. 1 is a diagram showing the entire structure of an image forming system SY of an embodiment in accordance with the invention.

Preferred embodiments in accordance with the invention will be described in detail, referring to the drawings. However, the scope of the invention is not limited to the examples shown in the drawings.

First Embodiment

First, the structure in a first embodiment will be described.

FIG. 1 shows the entire structure of an image forming system SY of an embodiment in accordance with the invention. As shown in FIG. 1, the image forming system SY is structured in such a manner that an image forming apparatus 100 and host devices 200 are connected via a communication network N, such as a LAN (Local Area Network) or a WAN (Wide Area Network), to allow transmitting and receiving of data.

The image forming device 100 can be, for example, a copier, printer, fax machine, or multifunction device. In the present embodiment, the image forming apparatus 100 will be described, taking an example of a multifunction machine by an electrophotographic method. The structure of the image forming apparatus 100 will be described in detail later.

Each host device 200 is a personal computer having a printer driver, application software for creating document data and image data, and the like mounted thereon corresponding to the image forming apparatus 100. The image forming apparatus 100 is provided with a CPU (Central Processing Unit), storage section, operation section such as a keyboard and mouse, display section such as a LCD (Liquid Crystal Display), communication section, and the like. When printing by the image forming apparatus 100 is instructed by the operation section, a host device 200 displays a print setting screen (not shown) on the display section, according to a program of the printer driver stored in the storage section. When tab printing is designated on the print setting screen, the host device 200 displays a tab print setting screen (not shown) as input means. When the quantity of print copies, the quantity of tabs per tab sheet set (the quantity of tab sheets per set) to be used, tab insertion pages (tab insertion positions), and the like are input on the tab print setting screen via the operation section, and execution of printing is instructed, the CPU transmits the inputted tab print setting information as control data, attaching to data of a printing object (hereinafter, referred to as print data), from the communication section to the image forming apparatus 100. Further, based on a control signal received from the image forming apparatus 100, the host device 200 displays an unnecessary tab sheet ejection selecting screen 201 (see FIG. 6) as selecting means, and the like, and outputs inputted selection information to the image forming apparatus 100, according to this screen.

The quantities of image forming apparatus 100 and host device 200 are not particularly limited. Further, although in the present embodiment, the image forming system SY is described, taking an example of a structure in which the image forming apparatus 100 and the host devices 200 are connected via the communication network N, it is also possible, for example, to have a structure in which connection is made via communication means such as a USB (Universal Serial Bus), a parallel port using a Centronics parallel port, and the like.

Figure 2:
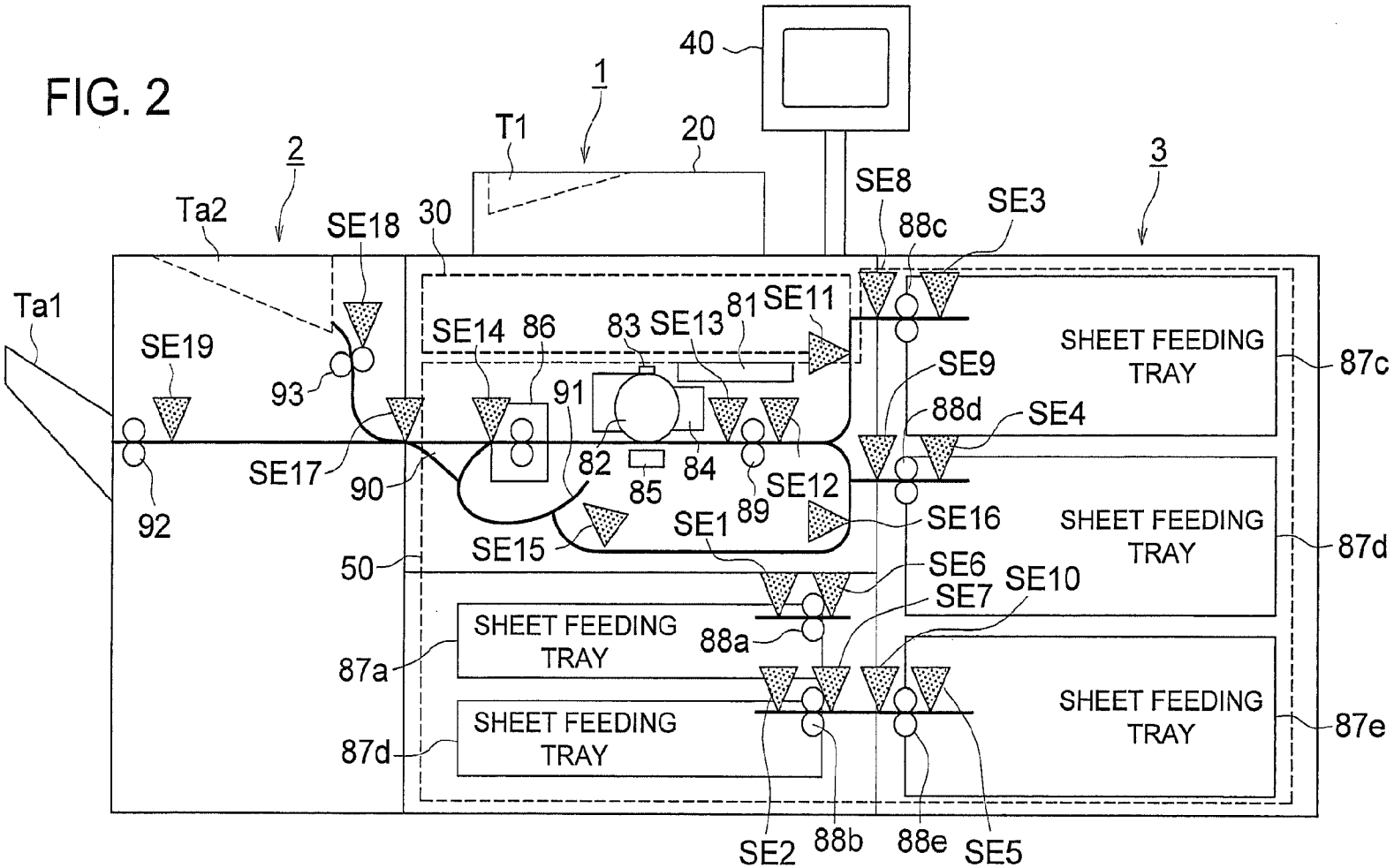
FIG. 2 is a schematic diagram showing the appearance structure and the inner structure of the image forming apparatus in FIG. 1.

FIG. 2 schematically shows the appearance and inner structures of the image forming apparatus 100. The image forming apparatus 100 includes a part of an image forming system in accordance with the invention, and, as shown in FIG. 2, includes an image forming device main body 1 (hereinafter, referred to as main body 1), and a post-processor 2 and a large capacity tray unit 3 connected as option. An operation display section 20 and an ADF (Auto Document Feeder) section 40 are provided on the top of the main body 1.

Figure 3:
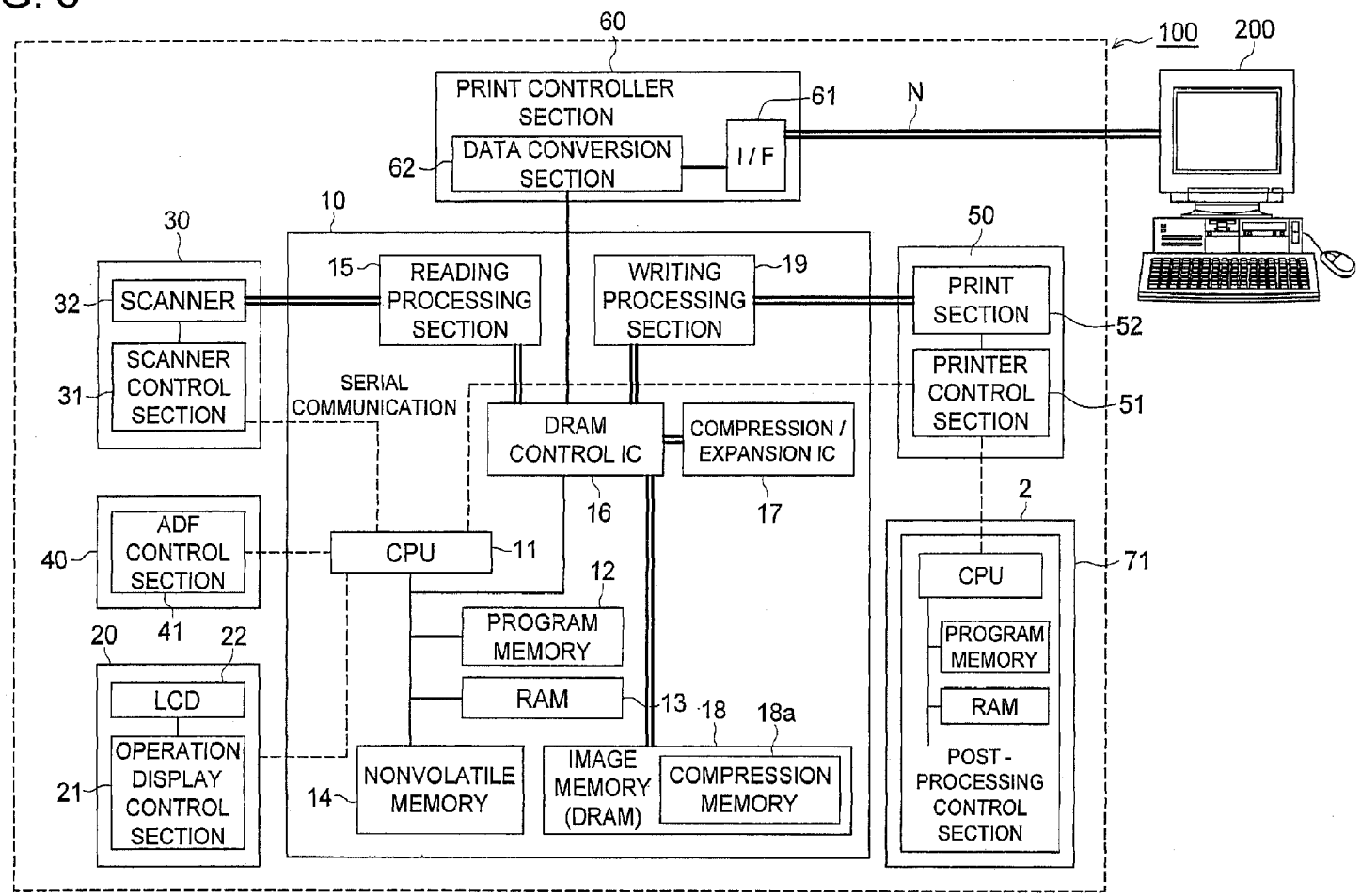
FIG. 3 is a block diagram showing the functional structure of the image forming apparatus 100 in FIG. 1.

FIG. 3 shows the functional structure of the image forming apparatus 100. A state managing section 10, operation display section 20, scanning section 30, ADF section 40, and printer section 50, shown in FIG. 3, are functions included in the main body 1, shown in FIG. 2. Respective sections constructing the image forming apparatus 100 will be described below, referring to FIG. 3.

The state managing section 10 includes a CPU 11, program memory 12, Ram (Random Access Memory) 13, nonvolatile memory 14, reading processing section 15, DRAM (Dynamic Random Access Memory) control IC 16, compression/expansion IC 17, image memory (DRAM) 18, and writing processing section 19.

CPU 11 reads out various processing programs including a system program, tab sheet insertion print processing program, unnecessary tab sheet ejecting program stored in the program memory 12, and loads the programs into RAM 13, so as to perform central control of the operations of the respective sections of the image forming apparatus 100, according to the loaded programs.

For example, CPU 11 stores setting information for each job, such as tab print setting information inputted via the operation display section 20 or a print controller section 60, into the job setting storage area of RAM 13, and executes jobs, according to the stored setting information. A job is a series of operations related to image forming such as printing. For example, in a case of copying plural sheets of documents, a series of operations related to copying the plural sheets of documents is a single job, and in a case of copying in a plural quantity of copies, a series of operations related to copying the plural copies is a single job.

Further, according to read-out programs, CPU 11 executes various processes including the tab insertion and print processing and the unnecessary-tab-sheet ejection processing which will be described later, to realize control means.

The program memory 12 is configured with a nonvolatile memory, such as a semiconductor and the like and stores various programs, such as the system program corresponding to the image forming apparatus 100, the tab insertion and print processing program executable on the system program, the unnecessary-tab-sheet ejecting processing program, and the like. Programs are stored in a form of program codes readable by a computer, and CPU 11 sequentially executes operations in accordance with the program codes.

In various processings executed and controlled by CPU 11, RAM 13 works as a temporary storage area for programs read-out from the program memory 12, input and output data, parameters, and the like. For example, RAM 13 has a job setting information storage area for temporarily storing setting information (for example, tab printing setting information) for each job.

The nonvolatile memory 14 stores various setting data and the like related to the image forming apparatus 100.

The reading processing section 15 converts analogue image signals, which have been read, by the scanning section 30 into digital image data and outputs the data to the DRAM control IC 16.

According to control from CPU 11, the DRAM control IC 16 compresses image data inputted from the reading processing section 15 and image data inputted from the print controller section 60 by the compression/expansion IC 17, and writes the compressed image data into a compression memory 18*a* of an image memory 18 to temporarily store the image data. Further, upon instruction from CPU 11 to output image data, the DRAM control IC 16 expands image data which is stored in the compression memory 18*a* and has been instructed to be output by the compression/expansion IC 17, and outputs the image data to the writing processing section 19. Still further, the DRAM control IC 16 outputs control data inputted from the print controller section 60 to CPU 11.

The compression/expansion IC 17 is an IC, which performs compression processing and expansion processing of image data under control by the DRAM control IC 16.

The image memory 18 is configured with a DRAM and includes the compression memory 18*a*. The compression memory 18*a* temporarily stores image data compressed by the compression/expansion IC 17 under control by the DRAM control IC 16.

The writing processing section 19 generates PWM (Pulse Width Modulation) signals based on image data inputted from the compression/expansion IC 17 and outputs the signals to the printer section 50.

The operation display section 20 includes an operation display control section 21 and an LCD 22.

The operation display control section 21 receives display signals from CPU 11 and controls display by the LCD 22. Further, the operation display section 20 outputs operation signals inputted via a touch panel on the LCD 22 to CPU 11.

Upon instruction by a display signal inputted from the operation display control section 21, the LCD 22 displays the states of various setting screens and images, the operation states of respective functions, and the like, on the screen. On the screen of the LCD, a touch panel is arranged which is a pressure sensitive type (resistance film pressure type) in which transparent electrodes are disposed in a grid form. The touch panel detects XY coordinates of a position pressed by a finger, touch pen, or the like via the voltage value, and outputs a detected position signal to the operation display control section 21 as an operation signal.

In addition, the operation display section 20 includes numerical buttons, function buttons to change various settings, operation modes, and the like, various operation buttons such as a start button, which are not shown, and outputs operation signals by button operations, from the operation display control section 21 to CPU 11.

In the present embodiment, the operation display section 20 displays a tab printing setting screen (not shown) for settings related to print jobs using tab sheets as input means on the LCD 22, and outputs tab printing setting information inputted via the tab printing setting screen to CPU 11. Further, the operation display section 20 displays an unnecessary tab sheet ejection selecting screen 201 (see FIG. 6) as selecting means on the LCD 22, and outputs selection information inputted in accordance with the screen, to CPU 11.

The scanning section 30 includes a scanner control section 31 and a scanner 32.

The scanner control section 31 receives a control signal from CPU 11 and performs drive control of the respective parts of the scanner 32. The scanner 32 includes a platen glass, CCD (Charge Coupled Device), and light source. A light from the light source illuminates and scans a document, and the reflected light is formed into an image by the CCD and subjected to photoelectric conversion so that the image of the document is read. The scanner 32 outputs the read analogue signal to the reading processing section 15.

The ADF section 40 includes an ADF control section 41, which controls the respective parts of the ADF section 40, according to control signals inputted from CPU 11, and automatically feeds documents mounted on a document tray T1 (see FIG. 2) onto the platen glass of the scanning section 30 one by one.

The printer section 50 includes a printer control section 51 and print section 52.

The printer control section 51 receives control signals from CPU 11 and controls the operations of the respective parts of the print section 52. Further, the printer control section 51 detects occurrence of a jam in the print section 52, the jam position, and release of the jam, and outputs the jam detection information to CPU 11. Still further, the printer control section 51 counts the quantity of transfer sheets fed for each job, and outputs the results to CPU 11. Yet further, the printer control section 51 performs relaying of data communication between CPU 11 and a post-processing control section 71.

The print section 52, as shown in FIG. 2, includes a LD (Laser Diode) 81, photoconductor drum 82, charging device 83, developing device 84, transfer section 85, and fixing device 86 which construct an image forming unit, sheet feeding trays 87*a* to 87*e* that feed transfer paper sheets, sheet feeding rollers 88*a* to 88*e*, as a conveying unit, that convey transfer sheets and tab sheets guided by a convey path (shown by thick lines and curves in FIG. 2) in the print section 52, various rollers such as a registration roller 89, a conveying path switching plate 90, a reversing section 91, and the like. According to a control from the printer control section 51, the conveying unit of the print section 52 feeds a transfer sheet or a tab sheet of a kind, size, and direction which are employed in the present job, from one of the sheet feeding trays 87*a* to 87*e*, and conveys the fed transfer sheet or tab sheet onto the conveying path. In the present embodiment, it is assumed that transfer sheets are stocked in the feeding tray 87*a* and tab sheets are stocked in the sheet feeding tray 87*b*. In the image forming unit, upon instruction from the printer control section 51, the charging device 83 charges the surface of the photoconductor drum 82, and according to a PWM signal inputted from the writing processing section 19, the LD 81 irradiates a laser beam onto the surface of the photoconductor drum 82 to form an electrostatic latent image, and the developing device 84 adheres toner to a region including the electrostatic latent image on the surface of the photoconductor drum 82. Then, the transfer section 85 transfers the toner to a transfer sheet or tab sheet conveyed from one of the sheet feeding trays 87*a* to 87*e* so as to form an image, the fixing device 86 fixes the image, and a sheet ejecting roller 94 as a feeding-out unit feeds out the transfer sheet on which an image has been formed to the post-processor 2. For dual side printing, a transfer sheet or tab sheet on which single side printing has been performed is conveyed through the conveying path switching plate 90 and a reversing path to the reversing section 91, reversed by the reversing section 91 with respect to the front side and the back side, conveyed again to the photoconductor drum 82 so as to form an image on the surface after the reversing, and fed out by the sheet ejecting roller 94 to the post-processor 2 after the image is fixed.

A plurality of sensors (for example, SE1 to SE 17) is provided in the conveying path of the print section 52, as shown in FIG. 2. These sensors generate a sensor signal when a transfer sheet passes by and outputs the sensor signal to the printer control section 51. The printer control section 51 is jam detecting means in the print section 52. Even after a predetermined time has elapsed since a transfer sheet passed by a certain sensor, if a sensor signal does not gets ON at the next sensor which is supposed to detect the transfer sheet, the printer control section detects an occurrence of a jam between the two sensors and outputs the jam detection information to CPU 11. Further, the printer control section 51 counts the quantity n1 of fed transfer sheets for each job by counting sensor signals outputted from one of the sensors SE1 to SE5 provided near the sheet feeding rollers 88*a* to 88*e*, and outputs the counted quantity n1 to CPU 11. Further, the printer control section 51 counts the quantity n3 of fed tab sheets at the time of unnecessary-tab-sheet ejection by counting sensor signals outputted from the sensor SE2 provided near the sheet feeding rollers 88*b*, and outputs the counted quantity n3 to CPU 11.

The post-processor 2 includes a post-processing control section 71 which performs control of the respective parts of the post-processor 2, according to control signals inputted from CPU 11 via the printer control section 51. The post-processing control section 71 is constructed by a CPU, a system program corresponding to the post-processor 2, a program memory that stores various processing programs executable on the system program, and a RAM. According to inputted control signals, the CPU of the post-processing control section 71 performs drive control of the respective sections in collaboration with the programs stored in the program memory. Further, CPU 11 conveys transfer sheets or tab sheets ejected from the printer section 50 by a conveying unit constructed by rollers, not shown, along a designated conveying path, piles on a piling unit 96 such as an intermediate stacker for each one copy, performs post-processing, such as staple processing, saddle-stitching processing, and folding, and ejects them onto a designated ejection tray (the first ejection tray Ta1 or the second ejection tray Ta2).

A plurality of sensors (for example, SE18 and SE 19) is provided in the conveying path of the post-processor 2, as shown in FIG. 2. These sensors generate a sensor signal when a transfer sheet or a tab sheet passes by and outputs the sensor signal to the post-processor control section 71. The post-processor control section 71 is a jam detecting unit in the post-processor 2. Even after a predetermined time has elapsed since a transfer sheet or tab sheet passed by a certain sensor, if a sensor signal does not get ON at the next sensor which is supposed to detect the transfer sheet or tab sheet, the post-processor control section 71 detects an occurrence of a jam between the two sensors and outputs the jam detection information to the printer control section 51. Further, the post-processor control section 71 counts the quantity n2 of ejected transfer sheets for each job by counting sensor signals outputted from the sensor SE18 or SE19 provided near the ejecting rollers 92 or 93, and outputs the counted quantity n2 to CPU 11.

The print controller section 60 includes an I/F 61, a data conversion section 62, and the like. The I/F 61 is an interface, such as a NIC (Network Interface Card) and a modem, for communication to make a connection with a communication network N, and transmits and receives data to and from the host devices 200. The data conversion section 62 converts print data inputted via the I/F 61 into image data in a data format that can be printed by the image forming apparatus 100 in a predetermined page description language, and outputs the image data with control data to a DRAM control IC 16.

Next, operations in the first embodiment will be described.

Figure 4:
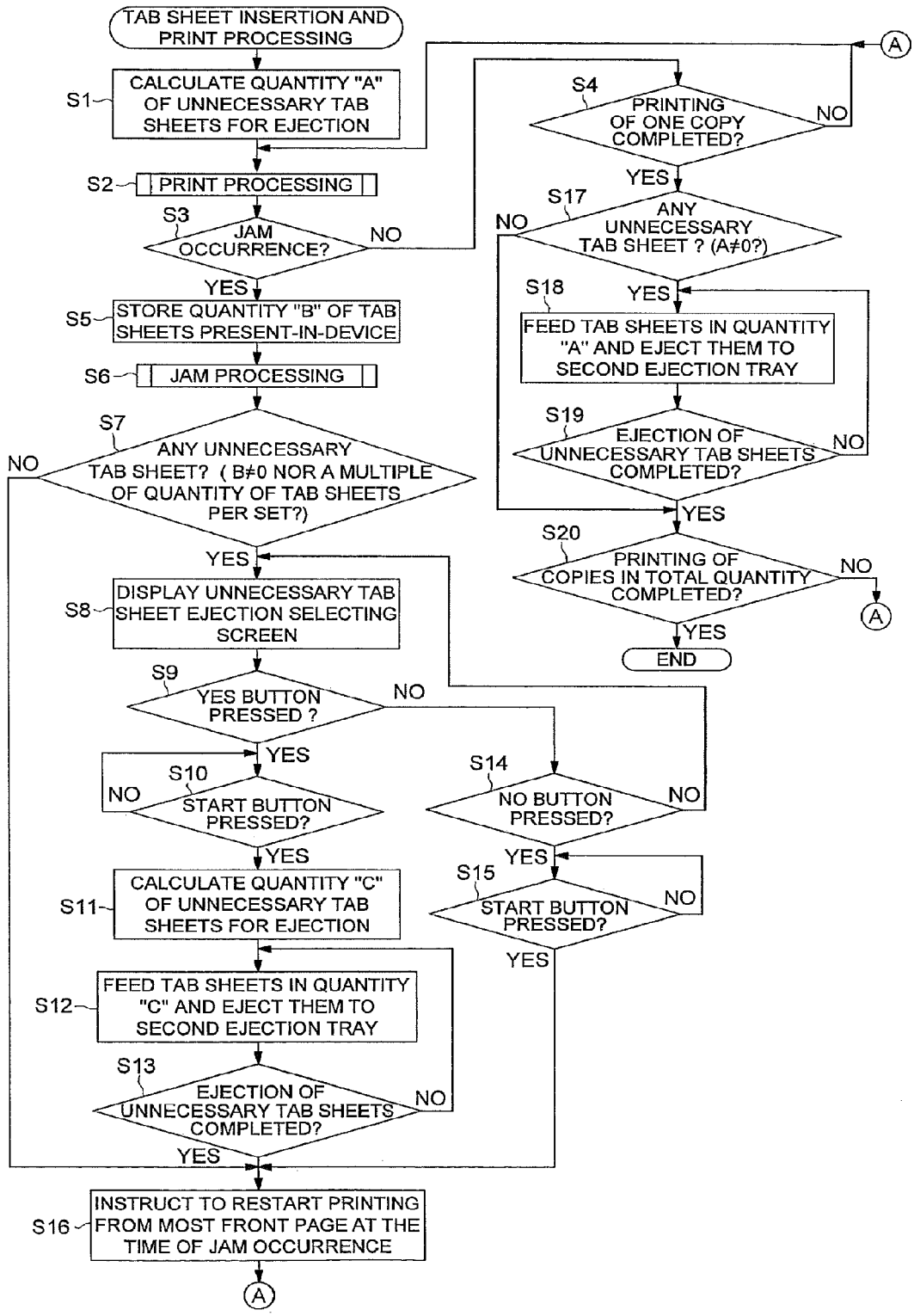
FIG. 4 is a flowchart showing tab sheet insertion and print processing executed by CPU 11 in FIG. 3.

FIG. 4 shows the tab-sheet insertion and print processing executed by the image forming apparatus 100. This processing is realized by software processing in collaboration between CPU 11 and a tab sheet insertion print processing program stored in the program memory 12. This processing is performed in a case where tab printing is set for a job to be executed. Incidentally, at the start of this processing, a notification of the start of print processing is output to the CPU of the post-processing control section 71.

First, quantity A of unnecessary tab sheets to be ejected is calculated (step S1). Specifically, from job setting information stored in the job setting information storage area in RAM 13, quantity m1 of tabs (the quantity of tab sheets) per tab sheet set to be used and quantity m2 of tabs (the quantity of tab sheets) to be used for one copy are obtained. Then quantity A of unnecessary tab sheets to be ejected is calculated by the following [Expression 1] and stored in RAM 13.

$$A = m1 - (\text{remainder of } m2/m1) \quad \text{[Expression 1]}$$

wherein, if m2 is an integer multiple of m1, then A=0.

Next, print processing is executed (step S2). Specifically, the printer control section 51 is instructed to perform printing, and image data for each page is read from an image memory 18 and output via the writing processing section 19 to the printer section 50. In the printer section 50, according to setting information stored in the job setting information storage area, a transfer sheet or tab sheet is conveyed from one of the sheet feeding trays 87*a* to 87*e*, corresponding to the page number of a document, an image is formed, namely, printed on the transfer sheet or tab sheet, based on the inputted image data, and the sheet is ejected to the first ejection tray Ta1 of the post-processor 2. When printing for one page is started, occurrence of a jam is monitored, and if occurrence of a jam is not detected (step S3; No), then it is determined whether printing for one copy is completed by the current print processing. Herein, if printing for one copy is not yet completed (step S4; NO), then the processing returns to step S2, and print processing is performed, based on the next image data. If printing for one copy is completed (step S4; YES), then the processing moves to step S17.

On the other hand, if an occurrence of a jam is detected (step S3; YES), quantity B of tab sheets present-in-apparatus, which is the quantity of tab sheets present in the image forming apparatus 100, is calculated and stored (step S5). Specifically, the printer control section 51 is inquired about quantity n1 of sheets (transfer sheets and/or tab sheets) having been fed by the present job and quantity n2 of sheets having been ejected. Then, quantity B of tab sheets present-in-apparatus is calculated, according to n1, n2, and tab sheet insertion pages having been set, and stored in RAM 13. Next, according to the jam detection information from the printer control section 51, the operation display section 20 displays a jam notifying screen (not shown) that notifies the occurrence of a jam and the jam position, and then the user executes jam processing to remove sheets present on a conveying path in the print section 50 or the post-processor 2 (step S6).

If jam processing is completed and the jam is released, it is determined whether there is an unnecessary tab sheet/sheets be ejected (step S7). Specifically, if quantity B of tab sheets present-in-apparatus B≠0, and quantity B of tab sheets present-in-apparatus is not an integer multiple of quantity m1 of tab sheets per tab sheet set to be used, then it is determined that there is an unnecessary tab sheet/sheets to be ejected. If quantity B of tab sheets present-in-apparatus B≠0, tab sheets in quantity B are removed by jam processing. To restart feeding tab sheets after the jam processing, sheet feeding must be performed starting with a tab sheet that is of the same kind as the most front one removed by the jam processing. If tab sheet feeding is restarted, starting with a tab sheet from the sheet feeding tray 87*b* without this adjustment, the tab sheet next to the last one which was present in the apparatus is output first, which causes a problem of restarting sheet feeding with a tab sheet of a wrong kind.

Figure 5:
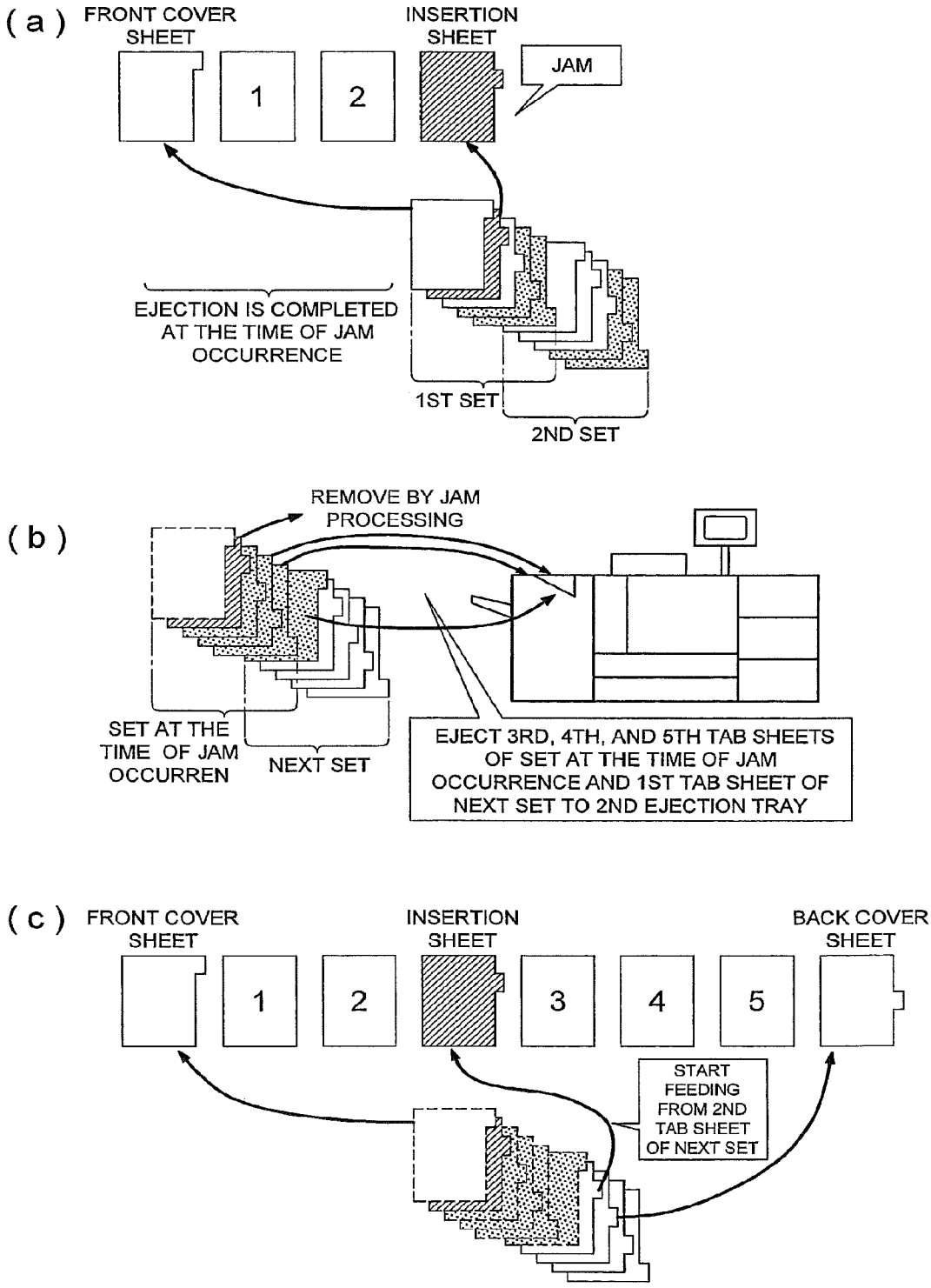
FIG. 5 (*a*) is a diagram schematically showing an example of jam occurrence, (*b*) is a diagram for illustration of ejection of unnecessary tab sheets performed in steps S12 and 13 in FIG. 3 when a jam has occurred under the conditions shown in (*a*), and (*c*) is a diagram for illustration of kinds of tab sheets which are fed when printing is resumed after releasing a jam and ejecting unnecessary tab sheets in a case where the jam has occurred under the conditions shown in (*a*)

An assumption is made in the following example, namely: quantity m1 of tab sheets per tab sheet set to be used is five (that is, there are tab sheets of five kinds in one set, which have different tab positions, namely from a tab sheet having the first tab to a tab sheet having the fifth tab), and insertion of tab sheets is set as "front cover sheet/back cover sheet/after the second page", in which quantity m2 of tabs (the quantity of tab sheets) to be used for one copy is accordingly set to be three; and, as an example, a jam has occurred with the tab sheet (the tab sheet having the second tab) to be inserted after the second page, as shown in FIG. 5 (*a*). Herein, if the tab sheet for the front cover sheet has been ejected, quantity B of tab sheets present-in-apparatus B=1. In this situation, as jam processing removes a sheet/sheets, which are present in the apparatus, the tab sheet with the second tab, is removed. To restart print processing after the jam processing, tab sheets must be fed starting with the second tab. To the contrary, if printing is restarted without this adjustment, as the tab sheet of the second tab has been already fed, the next fed tab sheet is a tab sheet of the third tab, which causes a problem of inserting a wrong tab sheet. In other words, the tab sheets with the third, fourth, and fifth tabs, and the tab sheet with the first tab of the next set, are unnecessary tab sheets.

However, if quantity B of tab sheets present-in-apparatus B=0 at the time of occurrence of a jam, or if B is an integer multiple of quantity m1 of tab sheets per tab sheet set to be used, there is no unnecessary tab sheet to be ejected, and it is possible to feed correct tab sheets even if print processing is restarted without the above adjustment after jam processing.

Figure 6:
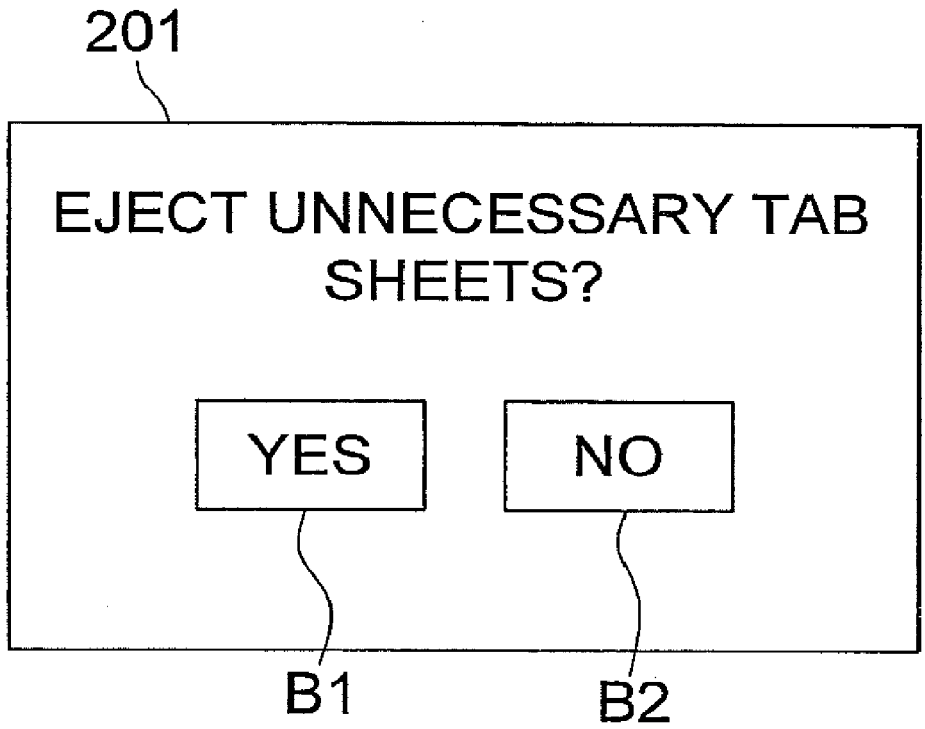
FIG. 6 is a diagram showing an example of an unnecessary tab sheet ejection selecting screen 201.

If it is determined that there is no unnecessary tab sheet to be ejected in step S7 (step S7; NO), the processing moves to step S16. If it is determined that there is an unnecessary tab sheet/sheets to be ejected in step S7 (step S7; YES), the operation display section 20 displays the unnecessary-tab-sheet ejection selecting screen 201 shown in FIG. 6 (step S8). On this unnecessary-tab-sheet ejection selecting screen 201, as shown in FIG. 6, YES button B1 to select ejection and No button B2 to select no ejection are displayed as well as characters "Eject unnecessary tab sheet?"

If YES button B1 is pressed via the unnecessary-tab-sheet ejection selecting screen 201 (step S9; YES), pressing of a start button is waited for. If the start button is pressed (step S10; YES), quantity C of unnecessary tab sheet for ejection is calculated (step S11). Specifically, quantity C of unnecessary tab sheet for ejection is calculated by the following [Expression 2].

$$C = m1 - (\text{remainder of } B/m1) \quad \text{[Expression 2]}$$

Then, the conveying unit is controlled via the printer control section 51 so that tab sheets for the calculated quantity C are fed from the sheet feeding trays having tab sheets mounted thereon and ejected from the second ejection tray Ta2 of the post-processor 2 (step S12). In a case where a jam has occurred under the conditions shown in FIG. 5 (*a*), the tab sheets of the third, fourth, fifth, and the tab sheet of the first tab of the next set are ejected, as shown in FIG. 5 (*b*). Thus, when printing is restarted, it is possible to restart sheet feeding from the tab sheet of the second tab which has been the most front on the sheet feeding tray 87*b* at the time of the occurrence of the jam, as shown in FIG. 5 (*c*). If ejection of unnecessary tab sheets is completed (step S13; YES), the processing moves to step S16.

On the other hand, if YES button B1 is not pressed (step S9; NO) and NO button B2 is pressed via the unnecessary tab sheet ejection selecting screen 201 (step S14; YES), pressing of the start button is waited for. At this meantime, the user can mount the tab sheet/sheets removed by the jam processing on the tray 87*b*. For example, in a case where a jam has occurred under the conditions shown in FIG. 5 (*a*), if the user mount one tab sheet with the second tub on the sheet feeding tray, it is possible, upon restarting printing, to start sheet feeding with the tab sheet with the second tab on the sheet feeding tray 87*b*. If the start button is pressed (step S15; YES), the processing moves to step S16.

In step S16, the respective parts of the state managing section 10 and the printer control section 51 are instructed to perform recovery processing, namely, to restart print processing from the most front page which was present in the apparatus at the time of jam occurrence (step S16), the processing returns to step S2, and print processing is performed from the most front page which was present in the apparatus at the time of jam occurrence.

If printing for one copy is completed (step S4; YES), the processing moves to step S17, and it is determined whether or not there is an unnecessary tab sheet to be ejected, in other words, it is determined whether quantity A≠0, which was calculated in step S1 and is the quantity of unnecessary tab sheets to be ejected. If A≠0 (step S17; YES), tab sheets in the calculated quantity A are fed from the sheet feeding tray 87*b* having tab sheets mounted thereon via the printer control section 51, and ejected from the second ejection tray Ta2 of the post-processor 2 (step S18). If ejection of the unnecessary tab sheets in quantity A is completed (step S19; YES), it is determined whether or not printing of copies of the total quantity to be output in the present job is completed. If printing of the total number of copies is not yet completed (Step S20; NO), the processing returns to step S2. If printing in the total number of copies to be printed in the present job is completed (step S20; YES), the present processing is completed.

Figure 7:
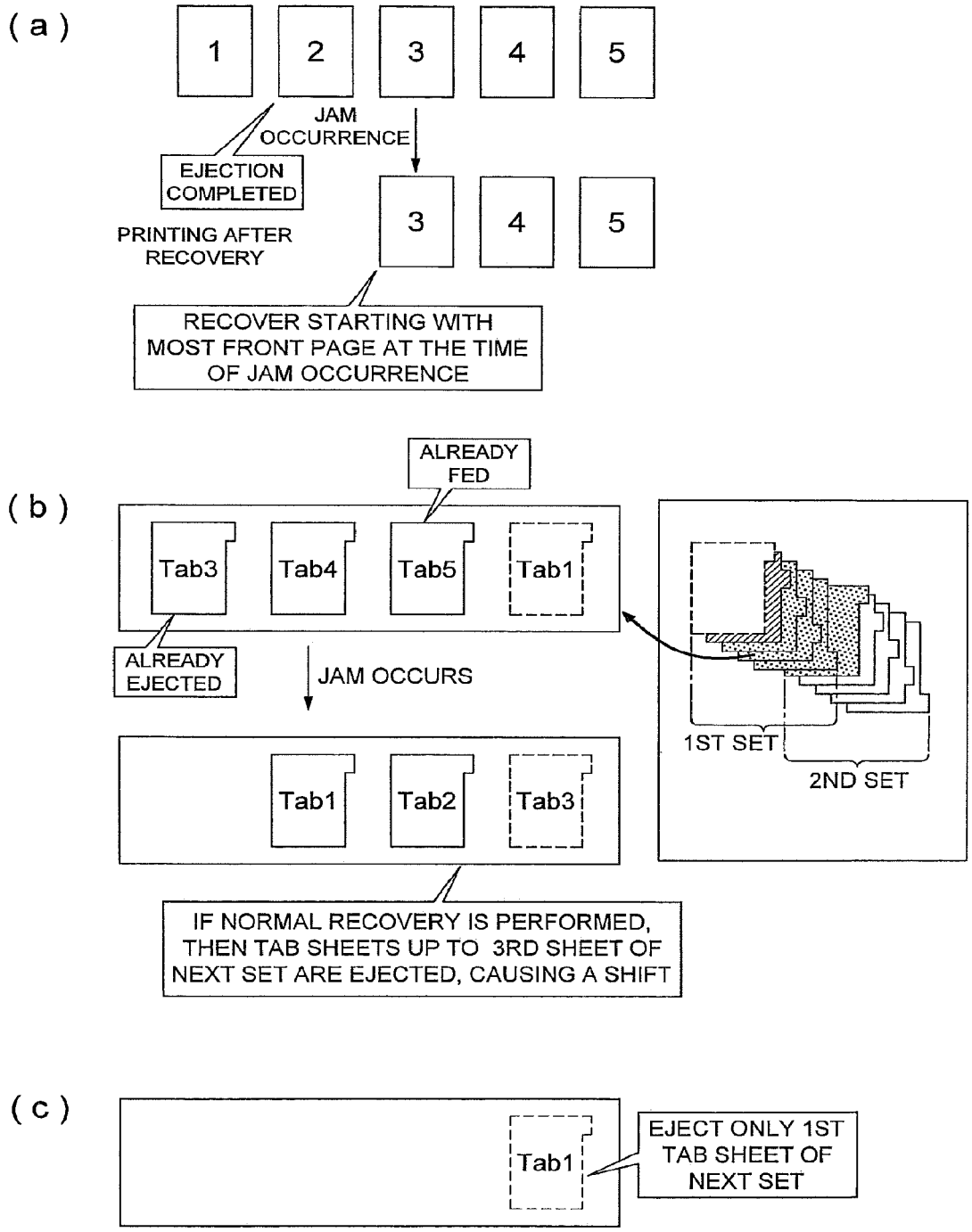
FIG. 7 (*a*) is a diagram for illustration of a normal recovery, (*b*) is a diagram for illustration of a case where the jam has occurred during ejection of unnecessary tab sheets and unnecessary tab sheet ejection is restarted, applying a normal recovery method after releasing the jam, and (*c*) is a diagram for illustration of a case where unnecessary tab sheet ejection is restarted, applying an unnecessary tab sheet ejection processing after releasing the jam.

Incidentally, it is possible that a jam occurs during when unnecessary tab sheets are ejected in steps S12 and S13, or in steps S18 and S19. For recovery after jam processing, print processing is restarted normally from the most front page at the time of the occurrence of the jam. For example, as shown in FIG. 7 (*a*), in a case where image data for five pages is sequentially printed on five ordinary transfer sheets of the same kind and the sheets are ejected, if a jam occurs at the third sheet after ejecting the second sheet, print processing is restarted from the third sheet. In a case where a jam has occurred during when unnecessary tab sheets have been ejected, if such a recovery as described above is performed after jam processing, ejection of unnecessary tab sheets may not be performed correctly.

For example, as shown in FIG. 7 (*b*), in a case of ejecting unnecessary tab sheets with the third, fourth, fifth tabs of a set of five tabs and the unnecessary tab sheet with the first tab of the next set, namely, ejecting four unnecessary tab sheets totally, if a jam occurs with the tab sheet with the fourth tab which is the second sheet, after ejecting the tab sheet with the third tab (Tab3) which is the first sheet, ejection of only one sheet is completed at the time of the jam occurrence. Therefore, when ejection of tab sheets is performed again after releasing the jam, three sheets are ejected by a normal recovery method. In a case where sheet feeding up to the tab sheet with the fifth tab has been completed at the time of the jam occurrence, three tab sheets with the first, second, and third tabs of the next set are ejected. This causes a problem that tabs are shifted when printing is performed after ejection of unnecessary tab sheets.

Figure 8:
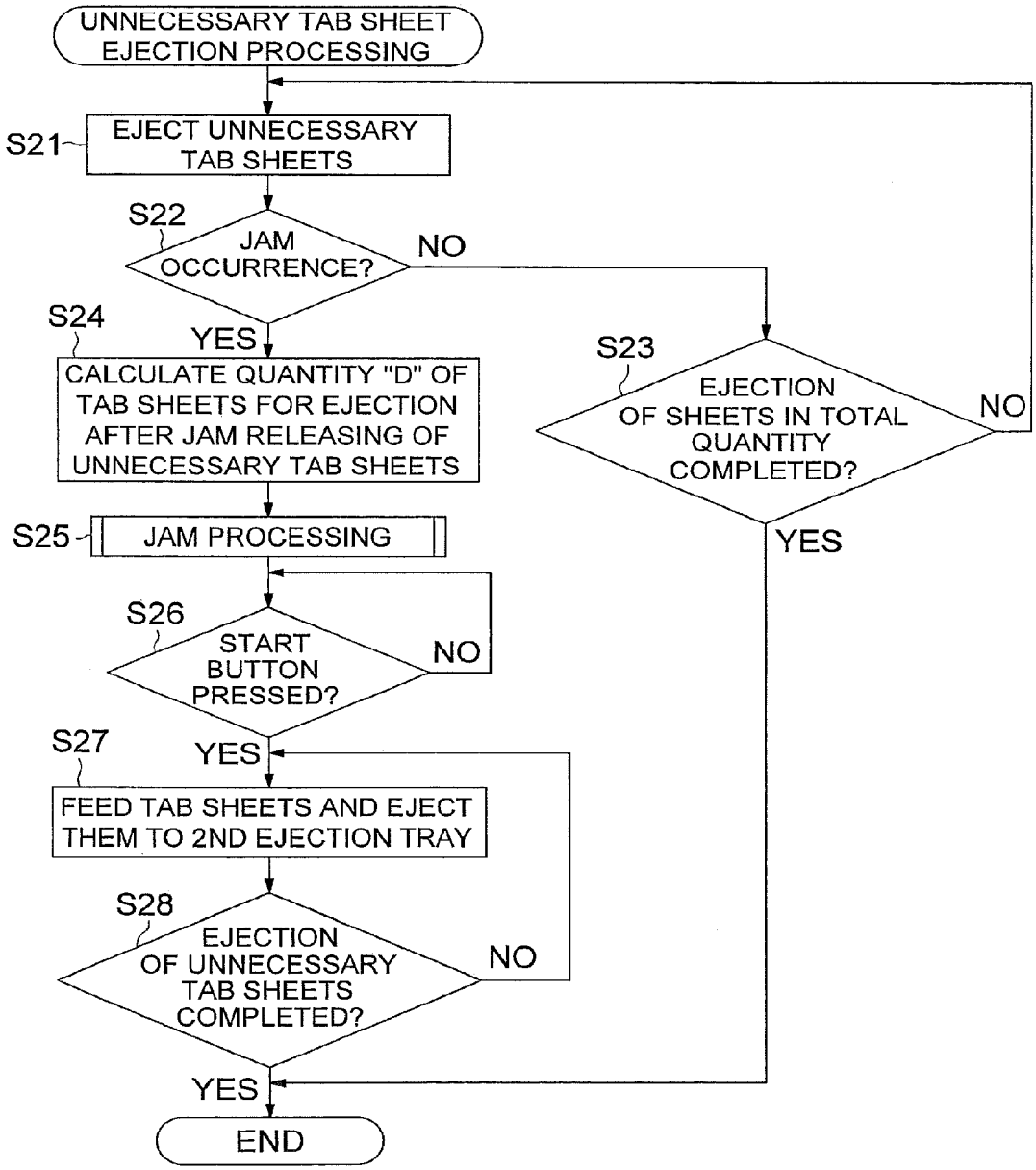
FIG. 8 is a flowchart showing unnecessary tab sheet ejecting processing executed by CPU 11.

To solve such a problem, it is preferable to perform unnecessary tab sheet ejection processing shown in FIG. 8, in steps S12 and S13, and in steps S18 and S19, shown in FIG. 4.

The unnecessary tab sheet ejection processing will be described below, referring to FIG. 8. This processing is realized by software processing in collaboration between CPU 11 and an unnecessary tab sheet ejection processing program stored in the program memory 12.

First, the printer control section 51 is instructed to eject tab sheets, and the conveying means of the printer section 50 and the post-processor 2 are controlled to execute ejection of unnecessary tab sheets (step S21). That is, in the printer section 50 and the post-processor 2, tab sheets are fed one by one from the sheet feeding tray 87*b*, which has tab sheets, mounted thereon, and are ejected from the second ejection tray Ta2 of the post-processor 2. After ejection of tab sheets is started, occurrence of a jam is monitored. If occurrence of a jam is not detected (step S22; NO), it is determined whether or not ejection of the total quantity of unnecessary tab sheets to be ejected is completed. If ejection of the total quantity of unnecessary tab sheets to be ejected is not completed yet (step S23; NO), the processing returns to step S21, the printer control section 51 is instructed to eject the next tab sheet, and this unnecessary tab sheet is ejected. If ejection of the total quantity of unnecessary tab sheets is completed (step S23; YES), the present processing terminates.

If occurrence of a jam is detected during ejection of unnecessary tab sheets (step S22; YES), quantity n3 of already fed tab sheets is obtained from the printer control section 51, and quantity D of tab sheets to be ejected after releasing the jam of an unnecessary tab sheet/sheets is calculated. Quantity D of tab sheets to be ejected after releasing the jam of an unnecessary tab sheet/sheets is calculated by the following [Expression 3] and stored in RAM 13 (step S24).

$$D = \text{quantity of unnecessary tab sheets for ejection } (A \text{ or } C) - n3 \qquad \text{[Expression 3]}$$

Next, the user executes jam processing to remove transfer sheets, which are present in the conveying path of the print section 50, or the post-processor 2 (step S25), and pressing of the start button is waited for. If the start button is pressed (step S26; YES), the printer control section 51 is instructed to eject tab sheets in quantity D, tab sheets are fed by the conveying unit from the sheet feeding tray 87*b* which have tab sheets mounted thereon, and the fed tab sheets are ejected from the second ejection tray Ta2 of the post-processor 2 (step S27). If ejection of unnecessary tab sheets in quantity D calculated in step S24 is completed (step S28; YES), the present processing terminates.

By performing the unnecessary tab sheet ejection processing described above, even if a jam occurs during ejection of unnecessary tab sheets, the order of tabs is prevented from being shifted. For example, as shown in FIG. 7 (*b*), in case of ejecting the unnecessary tab sheets with the third, fourth, and fifth tabs of a set of five tabs and the unnecessary tab sheet with the first tab of the next set, namely, ejecting four unnecessary tab sheets in total, if ejection of the tab sheet with the third tab is completed and tab sheets have been fed up to the tab sheet with the fifth tab at the time of the occurrence of a jam at the tab sheet with the fourth tab, it is possible to remove the tab sheets with the fourth and fifth tabs in jam processing, and then eject the tab sheet of the first tab, as shown in FIG. 7 (*c*), so as to start feeding of tab sheets from the tab sheet with the second tab in the next printing.

As described above, by the image forming system SY, if a jam occurs when printing is performed in such a way that tab sheets are inserted by setting quantity m1 of tab sheets per tab sheet set to be used and quantity m2 of tabs (the quantity of tab sheets) to be used for one copy, quantity B of tab sheets present-in-apparatus is obtained. Herein, if quantity B of tab sheets present-in-apparatus B≠0 and B is not an integer multiple of quantity m1 of tab sheets per tab sheet set to be used, the operation display section 20 displays the unnecessary tab sheet ejection selecting screen 201. Herein, if it is instructed to eject unnecessary tab sheets via the operation display section 20, quantity C of unnecessary tab sheets for ejection is calculated by expression C=m1−(remainder of B/m1). Thus, tab sheets in quantity C up to one that is preceding the tab sheet that is of the same kind as the page most front at the time of the occurrence of the jam are fed from the sheet feeding tray and ejected from the second ejection tray Ta2 of the post-processor 2, and printing is restarted from the page most front at the time of the occurrence of the jam. If no ejection of unnecessary tab sheets is selected via the operation display section 20, ejection of unnecessary tab sheets is not performed, and when the start button is pressed, printing is resumed.

Accordingly, even if a jam occurs during printing by the use of transfer sheets including tab sheets, the order of tabs is prevented from being shifted, thus allowing recovery. Further, if the user wants to reduce the quantity of tab sheets to be consumed, the user can compensate the sheet/sheets removed by jam processing instead of performing automatic ejection of unnecessary tab sheet/sheets and can continue printing.

Further, if a jam occurs during ejection of unnecessary tab sheets, a tab sheet/sheets, which are present at the time of the occurrence of the jam, are not handled as objects for recovery. Herein, the tab sheet/sheets, which are present in the apparatus, are removed by jam processing, and thereafter, tab sheet/sheets in the remaining quantity are fed from a sheet feeding tray, for which the quantity of the tab sheets having been present in the apparatus is subtracted. Accordingly, even if a jam occurs during ejection of unnecessary tab sheets, it is prevented that tab sheets are ejected more than required and that the order of tabs is shifted.

According to the above embodiment, even if occurrence of a jam is detected when a special sheet set is used, the set being a plurality of different kinds of special sheets that are disposed in a predetermined order, the order of special sheets to be used after releasing the jam is able to be prevented from shifting.

Also, according to the embodiment, when occurrence of a jam is detected, if one or more special sheets having been fed are present in the image forming system, it is possible to obtain a quantity of the one or more special sheets, and determine a quantity of unnecessary sheet or sheets to be ejected, according to the quantity of sheets per special sheet set and the quantity of the sheet or sheets which are present in the image forming system.

Further, according to the embodiment, an unnecessary sheet or sheets are ejected to an ejection tray other than an ejection tray for a transfer sheet on which an image has been formed or a special sheet. Accordingly, it is prevented that transfer sheets on which an image has been formed are mixed with unnecessary sheets, which relieves the user from the task of sorting out outputted transfer sheets from unnecessary sheets.

Also, it is possible to select whether or not to perform ejection of the unnecessary sheet or sheets. Therefore, if the user attempts to save the quantity of special sheets to be consumed, it is allowed for the user to supply necessary special sheets himself/herself instead of ejecting unnecessary sheets and continue outputting after releasing a jam.

According to the embodiment, when occurrence of a jam is detected by the jam detecting unit during ejection of the unnecessary sheet or sheets, if one or more special sheets having been fed are present in the image forming system, the quantity of the one or more special sheets is obtained, and after the jam being released, a special sheet or special sheets are ejected in a remaining quantity calculated by subtraction of the quantity of the sheet or sheets which were present in the image forming system from the quantity of the unnecessary sheet or sheets to be ejected. Therefore, even if a jam occurs during when unnecessary sheets are ejected, the order of special sheets to be used after releasing the jam is prevented from being shifted.

According to the embodiment, in a case where a special sheet set is used, the set being a plurality of different kinds of special sheets that are disposed in a predetermined order, if a quantity of special sheet or sheets to be used for one copy is not an integer multiple of the quantity of special sheets per special sheet set, a control is performed to eject an unnecessary special sheet or sheets each time output for one copy is completed, and when occurrence of a jam is detected during ejection of the unnecessary sheet or sheets, if one or more special sheets having been fed are present in the image forming system, the quantity of the one or more special sheets is obtained, and after the jam being released, a special sheet or special sheets are ejected in a remaining quantity calculated by subtraction of the obtained quantity of the one or more special sheets from the quantity of the unnecessary sheet or sheets to be ejected. Therefore, even if a jam occurs during when unnecessary sheets are ejected, the order of special sheets to be used after releasing the jam is prevented from being shifted.

Second Embodiment

Now, a second embodiment in accordance with the invention will be described.

The entire structure of an image forming system SY in the second embodiment is similar to the one described in the first embodiment, and accordingly the description of it is omitted. As the structure of an image forming apparatus 100 is approximately the same as the one described in the first embodiment, just differences will be described below. Incidentally, in the image forming apparatus 100, a main body 1 is connected with a post-processor 2, as shown in FIG. 2, and the image forming apparatus 100 includes a part of an image forming system in accordance with the invention.

A program memory 12 (see FIG. 3) of the main body 1 stores a tab-sheet-insertion and print processing B program, a print processing program, and the like, and a CPU 11, in collaboration with these programs, executes various processing including tab-sheet-insertion and print processing B (see FIG. 12) and print processing (see FIG. 13), which will be described later, so as to realize control means in the image forming apparatus.

A program memory of a post-processing control section 71 stores a conveying processing program and the like, and a CPU of the post-processing control section 71 executes conveying processing (see FIG. 14) in collaboration with this program, and, according to ejection instruction and attribute information from the main body 1, conveys transfer sheets sent out from the main body 1 or tab sheets mounted on PI 95 (see FIG. 11) along a designated conveying path by controlling convey rollers and the like, not shown, to realize conveying means for ejecting the sheets to an ejection tray (the first tray Ta1 or the second ejection tray Ta2).

Figure 11:
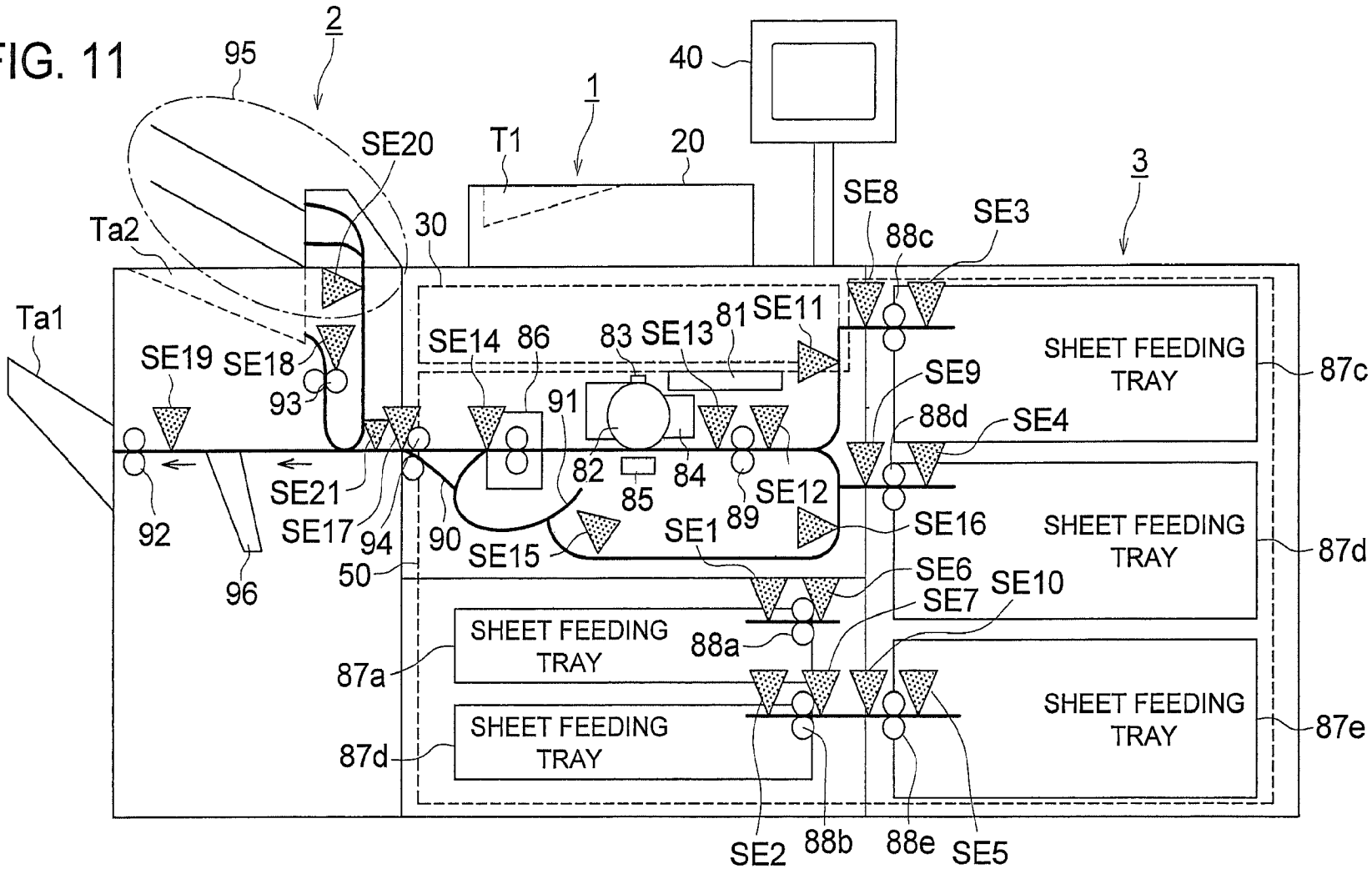
FIG. 11 is a diagram showing the appearance structure and the inner structure of an image forming apparatus 100 in a second embodiment.

FIG. 11 schematically shows the appearance and inner structure of the image forming apparatus 100 in the second embodiment.

In the present embodiment, the post-processor 2 is provided with a post-inserter (hereinafter, referred to as PI) having a special sheet tray to mount tab sheets on in addition to the structure shown in FIG. 2. Further, a plurality of sensors (for example, SE18, SE19, SE20, and SE21) are provided, as shown in FIG. 11, in the conveying path of the post-processor 2, to detect passing of a transfer sheet or tab sheet and generate a sensor signal, and output the signal to the post-processing control section 71. The CPU of the post-processing control section 71 is jam detecting means in the post-processor 2. Even after a predetermined time has elapsed since a transfer sheet or tab sheet passed by a certain sensor, if a sensor signal which is supposed to detect passing of the next sheet does not get ON, the CPU of the post-processing control section 71 detects an occurrence of a jam between the two sensors and outputs jam detection information via the printer control section 51 to CPU 11.

Further, when tab sheets for insertion are ejected, the CPU of the post-processing control section 71 counts, for each job, quantity nil of tab sheets (the quantity of fed insertion tab sheets) which have been fed from PI 95 for insertion by counting sensor signals outputted from the sensor SE20 provided near the sheet feeding part of PI 95, and counts quantity n12 of tab sheets (insertion tab sheets), which is the quantity of ejected tab sheets, having been ejected to the first ejection tray Ta1 by counting sensor signals outputted from the sensor SE 19 provided near ejection rollers 92. Still further, the CPU of the post-processing control section 71 counts quantity n13 of transfer sheets which have been conveyed from the main body 1 by counting sensor signals outputted from the sensor SE21 provided near the conveyance entrance for transfer sheets, and counts quantity n14 of transfer sheets which have been ejected to the first ejection tray Ta1 by counting sensor signals outputted from the sensor SE19 provided near ejection rollers 92. Yet further, when unnecessary tab sheets are ejected, the CPU of the post-processing control unit 71 counts quantity n15 of fed unnecessary tab sheets (the quantity of fed unnecessary tab sheets) which have been fed from PI 95 by counting sensor signals outputted from the sensor SE20 provided near the sheet feeding part of PI 95, and counts quantity n16 of unnecessary sheets which have been ejected to the second ejection tray Ta2 by counting sensor signals outputted from the sensor SE18 provided near ejection rollers 93.

Next, operations in the second embodiment will be described.

Figure 12:
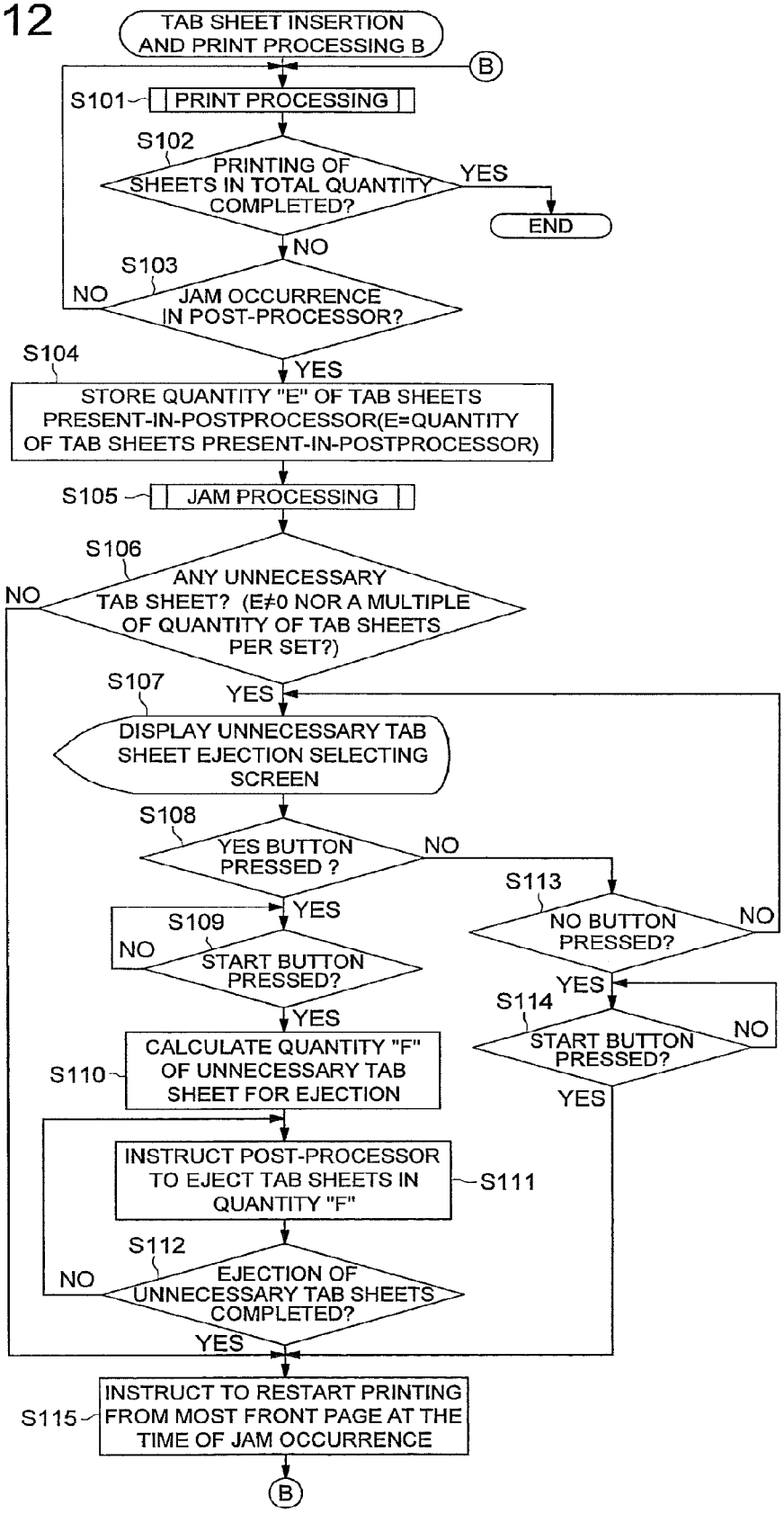
FIG. 12 is a flowchart showing tab sheet insertion and print processing B executed by CPU 11, shown in FIG. 3, in the second embodiment.

FIG. 12 shows a tab sheet insertion and print processing B executed by CPU 11 of the main body 1. This processing is realized by software processing in collaboration between CPU 11 and the tab sheet insertion and print processing program B stored in the program memory 12, and is executed in a case where tab printing is set for a job to be executed. At a start of this processing, a notification of a start of print processing is output to the CPU of the post-processing control section 71.

The tab sheet insertion and print processing B is different from the tab sheet insertion and print processing in the first embodiment in that tab sheets are fed from PI 95 provided in the post-processor 2 to insert tab sheets.

First, print processing is executed (step S101).

Figure 13:
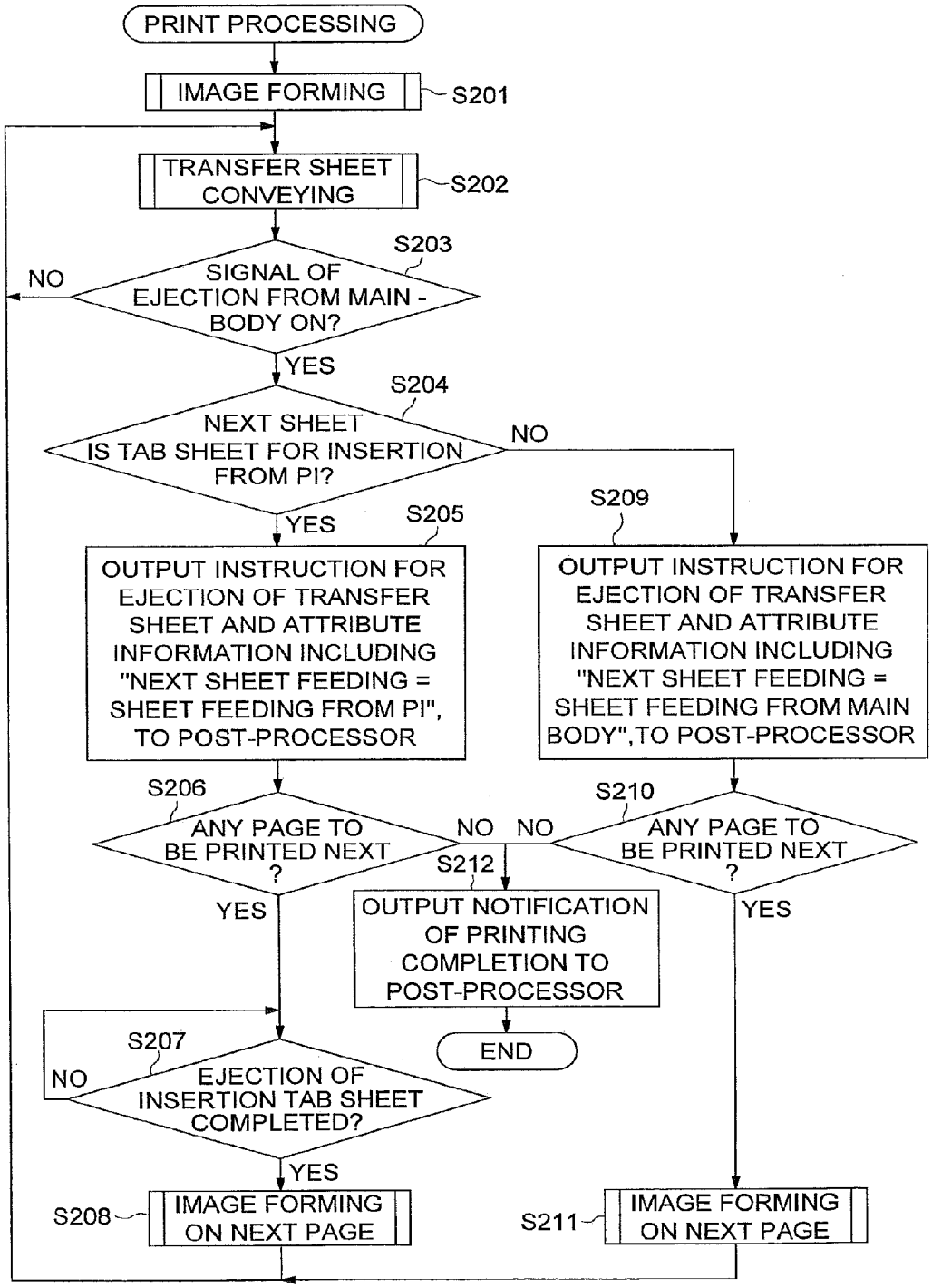
FIG. 13 is a flowchart showing a print processing executed by CPU 11, shown in FIG. 3, in the second embodiment.

FIG. 13 shows a print processing executed by CPU 11 in step S101.

First, the printer control section 51 is instructed to perform printing; image data of the first page is read out from an image memory 18; an image is formed on a transfer sheet, based on the read image data, namely, an image is printed (step S201); and the transfer sheet on which the image has been formed is conveyed on a conveying path (step S202). When the transfer sheet reaches the sheet ejection sensor SE17 and a sensor signal gets ON (signal of ejection from main-body), and a signal of ejection from main-body is input from the printer control section 51 (step S203; YES), it is determined whether or not to insert a tab sheet from PI 95 following this transfer sheet, based on setting information stored in a job setting information storage area. If it is determined to insert a tab sheet from PI 95 (step S204; YES), an instruction to eject the transfer sheet on which the image has been formed and attribute information including information which indicates that the next sheet to be fed is an insertion tab sheet from PI 95, are output to the CPU of the post-processing control unit 71 (step S205). The attribute information is information on a transfer sheet to be sent out to the post-processor 2, and includes, for example, information on the next sheet to be fed as well as the size, the kind of a paper sheet, the kind of post-processing, and the like.

Figure 9:
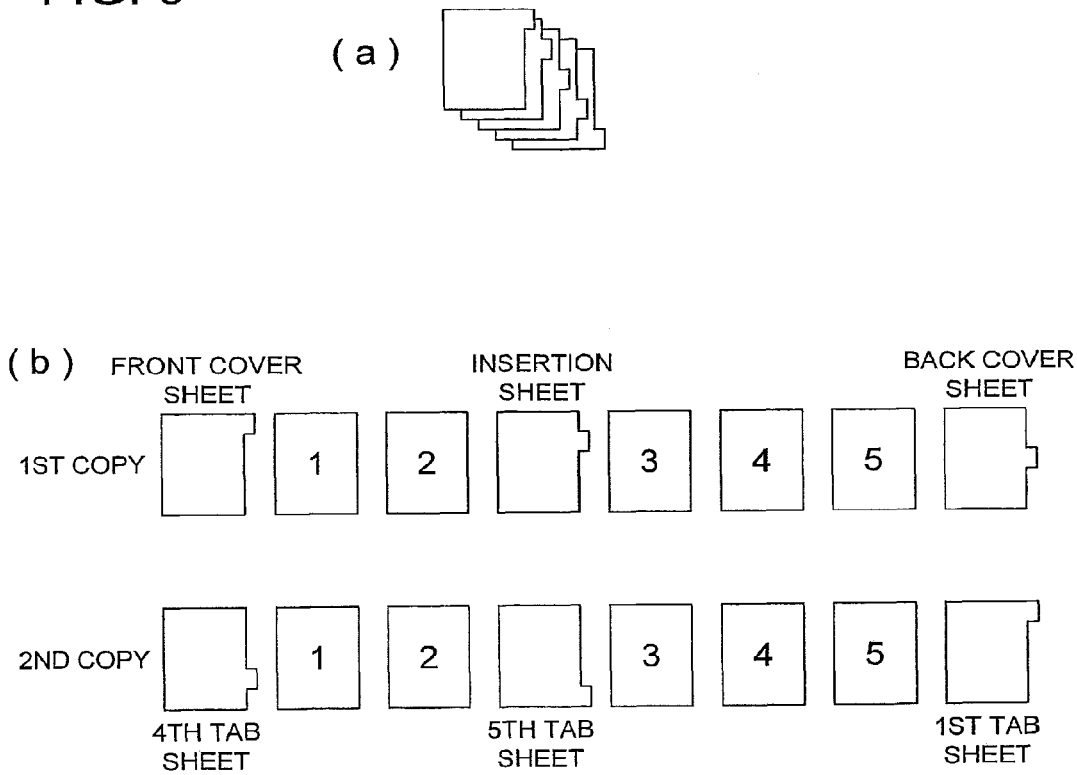
FIG. 9 is a diagram for illustration of a prior art.
Figure 10:
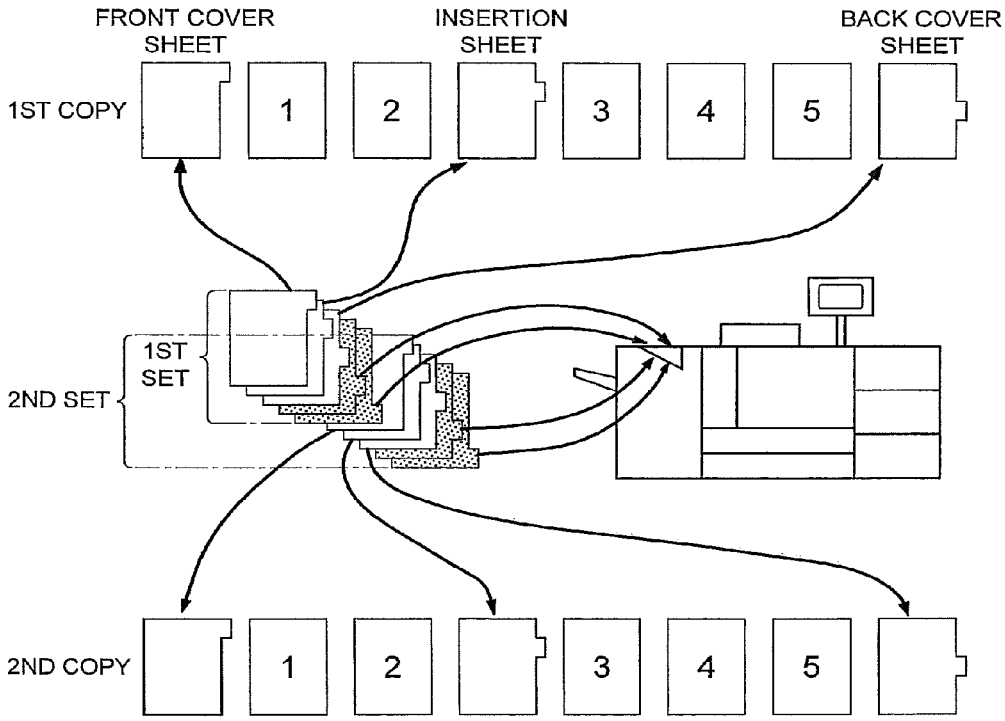
FIG. 10 is a diagram for illustration of a prior art.

As described before, if the quantity of tab sheets to be used for printing one copy is not an integer multiple of the quantity of tab sheets per set, there become unnecessary tab sheets each time printing of one copy is completed (see FIG. 9). Therefore, it is preferable to calculate quantity A of unnecessary tab sheets for ejection by [Expression 1] described in the description of step S1 in FIG. 4, and if A≠0, preferable to eject unnecessary tab sheets each time printing of one copy is completed. In this case, by calculating with CPU 11 quantity A of unnecessary tab sheets for ejection and by adding, to the attribute information of the last transfer sheet of one copy, information on quantity A of unnecessary tab sheets for ejection and the conveying destination (the second ejection tray Ta2) of the tab sheets (unnecessary tab sheets) in quantity A, it is possible to perform control to eject unnecessary tab sheets from the second tab sheet ejection tray Ta2 each time printing of one copy is completed.

Next, based on setting information stored in the job setting information storage area, it is determined whether or not there is a page to be printed next, and if there is a page to be printed next (step S206; YES), then a notification, from the CPU of the post-processing control section 71, of ejection completion of the tab sheet for insertion (insertion tab sheet) fed from PI 95 is waited for. If a notification of ejection completion of insertion tab sheet is input (step S207; YES), then image forming is performed on the next page in the print section 52 (step S208), and the processing returns to step S202. If there is no page to be printed next (step S206; NO), then a notification of completion of printing is output to the CPU of the post-processing control section 71 (step S212), and the present processing terminates.

On the other hand, in step S204, if it is determined that no tab sheet is inserted next from PI 95 (step S204; NO), instruction to eject the transfer sheet on which an image has been formed and attribute information including information which indicates that the next sheet to be fed is fed from the main body 1 are output to the CPU of the post-processing control section 71 (step S209). Then, based on setting information stored in the job setting information storage area, it is determined whether or not there is a page to be printed next, and if there is a page to be printed next (step S210; YES), image forming on the next page is performed in the print section 52 (step S211), and the processing returns to S202. If there is no page to be printed next (step S210; NO), then a notification of completion of printing is output to the CPU of the post-processing control section 71 (step S212), and the present processing terminates.

Figure 14:
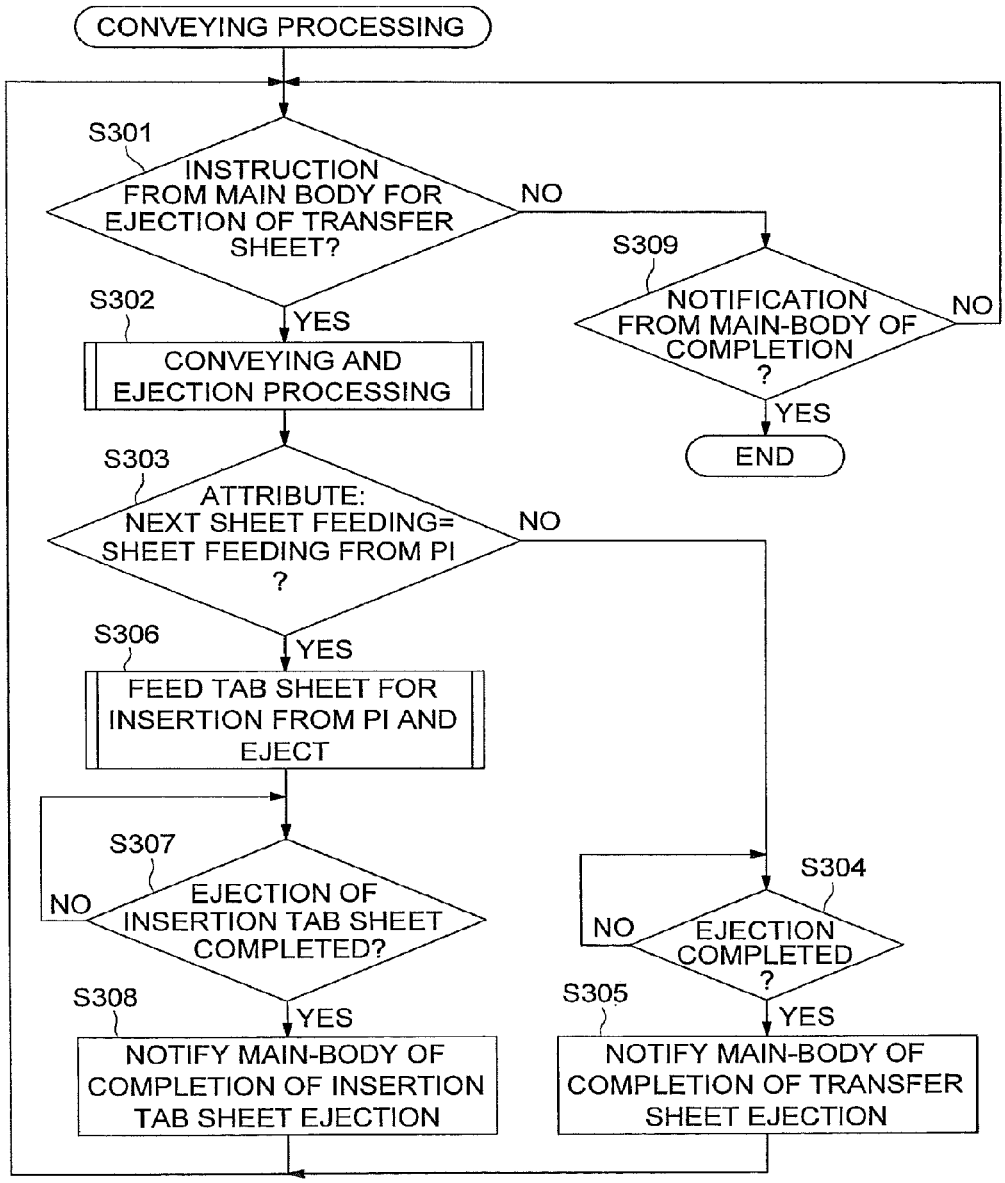
FIG. 14 is a flowchart showing a conveying process executed by a CPU of a post-processing control section 71 in FIG. 3.

The CPU of the post-processing control section 71 always monitors input from CPU 11 of the main body 1, and if a notification of a start of print processing is input from the main body 1, conveyance processing shown in FIG. 14 is executed.

If an instruction to eject a transfer sheet and attribute information on the transfer sheet are input from CPU 11 of the main body 1 (step S301; YES), the transfer sheet fed out from the main body 1 and conveyed from the conveyance entrance is conveyed along the conveying path to be ejected from the first tray Ta1 (step S302). In the case where the attribute information inputted in step S301 does not include information indicating that the next sheet to be fed is from PI 95 (step S303; NO), if ejection completion of the transfer sheet from the first ejection tray Ta1 is detected by the sensor SE19 (step S304; YES), a notification of ejection completion of the transfer sheet is output to CPU 11 of the main body 1 (step S305), and the processing returns to step S301.

On the other hand, in the case where the attribute information inputted in step S301 includes information indicating that the next sheet to be fed is from PI 95 (step S303; YES), a tab sheet for insertion is fed from PI 95 and ejected from the first ejection tray Ta1 (step S306). Incidentally, in the case where information on quantity A of unnecessary tab sheets for ejection and the conveying destination (the second ejection tray Ta2) of the tab sheets (unnecessary tab sheets) in quantity A is added to the attribute information of the last transfer sheet of one copy, unnecessary tab sheets are ejected from the second ejection tray Ta2 (unnecessary sheet ejection means) each time ejection of transfer sheets and tab sheets for one copy is completed.

Herein, when the sensor SE20 has detected that an insertion tab sheet has been fed from PI 95, a notification of the feeding of the insertion tab sheet is output to CPU 11. When the sensor SE 19 has detected ejection completion of the insertion tab sheet from the first ejection tray Ta1 (step S307), a notification of ejection completion of the insertion tab sheet is output to CPU 11 of the main body 1 (step S308), and the processing returns to step S301.

In step S301, if, not an instruction to eject a sheet (step S301; NO), but a notification of termination of print processing is input (step S309; YES), the present processing terminates.

In the post-processing control section 71, when conveyance processing is started, monitoring of occurrence of a jam in the post-processor 2 is started. If a jam has occurred, detection information (including the jam position) on the jam is output to CPU 11.

Coming back to FIG. 12, if execution of print processing is started, completion of print processing and detection information on a jam from the post-processing control section 71 are monitored. If print processing is completed and printing for the total quantity of sheets is completed (step S102; YES), the present processing terminates.

If jam detection information is input from the CPU of the post-processing control section 71 during print processing (step S103; YES), quantity E of tab sheets present-in-post-processor which is the quantity of tab sheets that are present in the post-processor 2 at the time of an occurrence of a jam is calculated and stored (step S104). Specifically, CPU 11 counts the number of notifications of feeding of an insertion tab sheet and the number of notifications of ejection completion of an insertion tab sheet inputted from the CPU of the post-processing control unit 71, then, calculates quantity E of tab sheets present-in-postprocessor which is obtained from the difference between the number of notifications of feeding of an insertion tab sheet and the number of notifications of ejection completion of an insertion tab sheet, and stores the calculated quantity E of tab sheets present-in-postprocessor into RAM 13. Then, according to the jam detection information from the CPU of the post-processing control unit 71, the operation display section 20 displays a jam notifying screen (not shown) that notifies the occurrence of the jam and the jam position, and the user executes jam processing to remove the sheets which are present on the conveyance path in the post-processor 2 (step S105).

If jam processing is completed and the jam is released, it is determined whether or not unnecessary tab sheets are present (step S106). Specifically, if quantity E of tab sheets present-in-postprocessor E≠0 and quantity E is not an integer multiple of quantity m1 of tab sheets per tab sheet set, it is determined that unnecessary tab sheets are present. If quantity E of tab sheets present-in-postprocessor E≠0 and quantity E is not an integer multiple of quantity m1 of tab sheets per tab sheet set to be used, tab sheets in quantity E are removed by jam processing. In feeding tab sheets after the jam processing, tab sheets must be fed starting with a tab sheet of the same kind as the most front one of the tab sheets removed by the jam processing. If a tab sheet is fed from PI 95 without this adjustment, a problem is caused that a tab sheet of the next to that of the last tab sheet having been present in the postprocessor is output, as described referring to FIG. 5. If quantity E of tab sheets present-in-postprocessor E=0 at the time of jam occurrence or quantity E is an integer multiple of quantity m1 of tab sheets per tab sheet set to be used, the next tab sheet is of the same kind as the most front tab sheet removed by the jam processing. Accordingly, there are no unnecessary tab sheets, and even if print processing is restarted without adjustment after the jam processing, it is possible to feed correct tab sheets.

In step S106, if it is determined that there is no unnecessary tab sheet to be ejected (step S106; NO), then the processing moves to step S115. If it is determined that there is an unnecessary tab sheet/sheets to be ejected (step S106; YES), then an unnecessary tab sheet ejection selecting screen 201, shown in FIG. 6, is displayed on the operation display section 20 (Step S107).

If YES button B1 is pressed via the unnecessary tab sheet ejection selecting screen 201 (step S108; YES), then pressing of the start button is waited for, and if the start button is pressed (step S109; YES), quantity F of unnecessary tab sheets for ejection is calculated (step S110). Specifically, the following [Expression 4] calculates quantity of unnecessary tab sheets.

$$F = m1 - (\text{remainder of } E/m1) \qquad \text{[Expression 4]}$$

Then, ejection of unnecessary tab sheets in the calculated quantity F is instructed to the post-processing control section 71 (step S111). Upon instruction from CPU 11 to eject unnecessary tab sheets in quantity F from the second ejection tray Ta2, the post-processing control section 71 sequentially feeds tab sheets in quantity F from PI 95, and conveys them to the second ejection tray Ta2 to eject. The CPU of the post-processing control section 71 counts the number of sensor signals, inputted from the sensor SE18, which detect ejection of tab sheets to the second sheet ejection tray Ta2, and when the counted number reaches F, notification of ejection completion of the unnecessary tab sheets is output to CPU 11.

If the notification of ejection completion of the unnecessary tab sheets is input from the post-processing control section 71 (step S112; YES), then the processing moves to step S115.

On the other hand, if YES button B1 is not pressed via the unnecessary tab sheet ejection selecting screen 201 (step S108; NO), but No button B2 is pressed (step S113; YES), then pressing of the start button is waited for. During the time, the user can mount the tab sheet removed by jam processing onto PI 195. For example, when a jam occurs under the conditions shown in FIG. 5 (*a*), if a single tab sheet with the second tab is mounted onto the sheet feeding tray, it is possible to feed from the tab sheet with the second tab from PI 95 in restarting printing. If the start button is pressed (step S114; YES), then the processing moves to step S115.

In step S115, recovery processing, that is, restart of printing processing from the most front page which was present in the post-processor at the time of the occurrence of the jam is instructed to the respective parts of the state managing section 10, the printer control section 51, and the CPU of the post-processing control section 71 (step S115), the processing moves to step S101, and printing processing is performed from the most front page which was present in the post-processor at the time of the occurrence of the jam. If printing for the total quantity is completed (step S102; YES), the present processing terminates.

A jam may occur during ejection of unnecessary tab sheets in steps S111 and 112 or during ejection of unnecessary tab sheets at each time of completion of printing for one copy. Recovery after jam processing is normally performed restarting with the page, which was the most front at the time of occurrence of a jam. For example, as described in the first embodiment and shown in FIG. 7 (*a*), in a case where image data for five pages is printed sequentially onto five plain transfer sheets of the same kind, if a jam occurs at the third sheet after the ejection of the second sheet, printing processing restarts from the third sheet. In a case where a jam occurs during ejection of unnecessary tab sheets, if a similar recovery is performed after jam processing, unnecessary tab sheets may not be ejected correctly.

For example, as shown in FIG. 7 (*b*), in a case of ejecting four unnecessary tab sheets with the third, fourth, fifth tabs of a five tab set and the first tab of the next set, if a jam occurs at the tab sheet with the fourth tab which is the second sheet, after ejection of the tab sheet with the third tab (Tab3) which is the first sheet, a normal recovery method ejects three sheets in ejecting again after jam releasing because only a single sheet was ejected at the time of the jam occurrence. If feeding of tab sheets up to the tab sheet of the fifth tab was completed by the jam occurrence, three tab sheets with the first, second, and third tabs of the next set are ejected. This causes a shift in tabs in printing after the ejection of unnecessary tab sheets.

In order to solve such a problem, in a case where a jam has occurred during ejection of unnecessary tab sheets in steps S111 and 112 or after completion of printing for one copy, CPU 11 obtains, from the post-processing section 71, quantity n15 of unnecessary tab sheets having been fed and calculates quantity G of tab sheets to be ejected after the jam of the unnecessary tab sheets. Quantity G of tab sheets to be ejected after the jam of the unnecessary tab sheets is calculated by the following [Expression 5] and stored into RAM 13.

$$G = \text{quantity of unnecessary tab sheets for ejection } (A \text{ or } F) - n15 \qquad \text{[Expression 5]}$$

If the user executes jam processing to remove transfer sheets that are present in the conveying path of the post-processor 2, and presses the start button after releasing the jam, ejection of tab sheets in quantity G is instructed to the CPU of the post-processing control section 71. Upon instruction to eject tab sheets in quantity G, the CPU of the post-processing control section 71 sequentially feeds tab sheets as unnecessary tab sheets for quantity G from PI 95 and ejects them from the second ejection tray Ta2. The CPU of the post-processing control section 71 counts the number of sensor signals, outputted from the sensor SE18, at the time of ejecting tab sheets to the second sheet ejection tray Ta2, and when the counted number reaches G, notification of ejection completion of the unnecessary tab sheets is output to CPU 11. If the notification of ejection completion of the unnecessary tab sheets is input from the CPU of the post-processing control section 71 to CPU 11, ejection of unnecessary tab sheets terminates.

As described above, even in a case where a jam has occurred during ejection of unnecessary tab sheets, if the quantity of unnecessary tab sheets to be ejected after the jam is controlled, the order of tabs is not shifted. For example, in a case of ejecting four unnecessary tab sheets with the third, fourth, and fifth tabs of a five tab set and with the first tab of the next set, as shown in FIG. 7 (*b*), if tab sheets up to the tab sheet with the fifth tab have been fed when ejection of the tab sheet with the third tab is completed and a jam occurs at the tab sheet with the fourth tab, it is possible to start feeding of sheets from the tab sheet with the second tab at the next printing, by removing the tab sheets with the fourth and fifth tabs by jam processing and thereafter ejecting the tab sheet with the first tab, as shown in FIG. 7 (*c*).

As described above, with the structure in which tab sheets are mounted on PI 95 of the post-processor 2 in the second embodiment, the order of tabs is not shifted even if a jam occurs during printing in which transfer sheets including a tab sheet/sheets are used, and thus recovery is achieved.

Further, if the user attempts to consume fewer tab sheets, it is possible to continue printing with user's feeding of sheets removed by jam processing instead of performing automatic ejection of unnecessary tab sheets.

Still further, in a case where a jam has occurred during ejection of unnecessary tab sheets, tab sheets which are present in the post-processor at the time of the occurrence of the jam are not handled as recovery objects, the tab sheets present in the post-processor are removed by jam processing, and thereafter tab sheets in a remaining quantity for which the quantity of the removed sheets is subtracted are fed from the sheet feeding tray. Accordingly, even if a jam occurs during ejection of unnecessary tab sheets, the order of tabs is prevented from shifting which could be caused by ejection of tab sheets more than required.

In the second embodiment, a case where a jam occurs during printing in which transfer sheets including tab sheets are used has been described above, taking an example where CPU 11 of the main body 1 calculates the quantity of unnecessary tab sheets to be ejected by the post-processor 2 and controls the post-processor 2 to eject the unnecessary tab sheets. However, as described below as a modified example of the second embodiment, unnecessary tab sheets may be ejected in such a manner that the CPU of the post-processing section 71 calculates unnecessary tab sheets to be ejected by the post-processor and controls conveying in the post-processor 2.

Modification of Second Embodiment

A modified example of the second embodiment will be described below.

Figure 15:
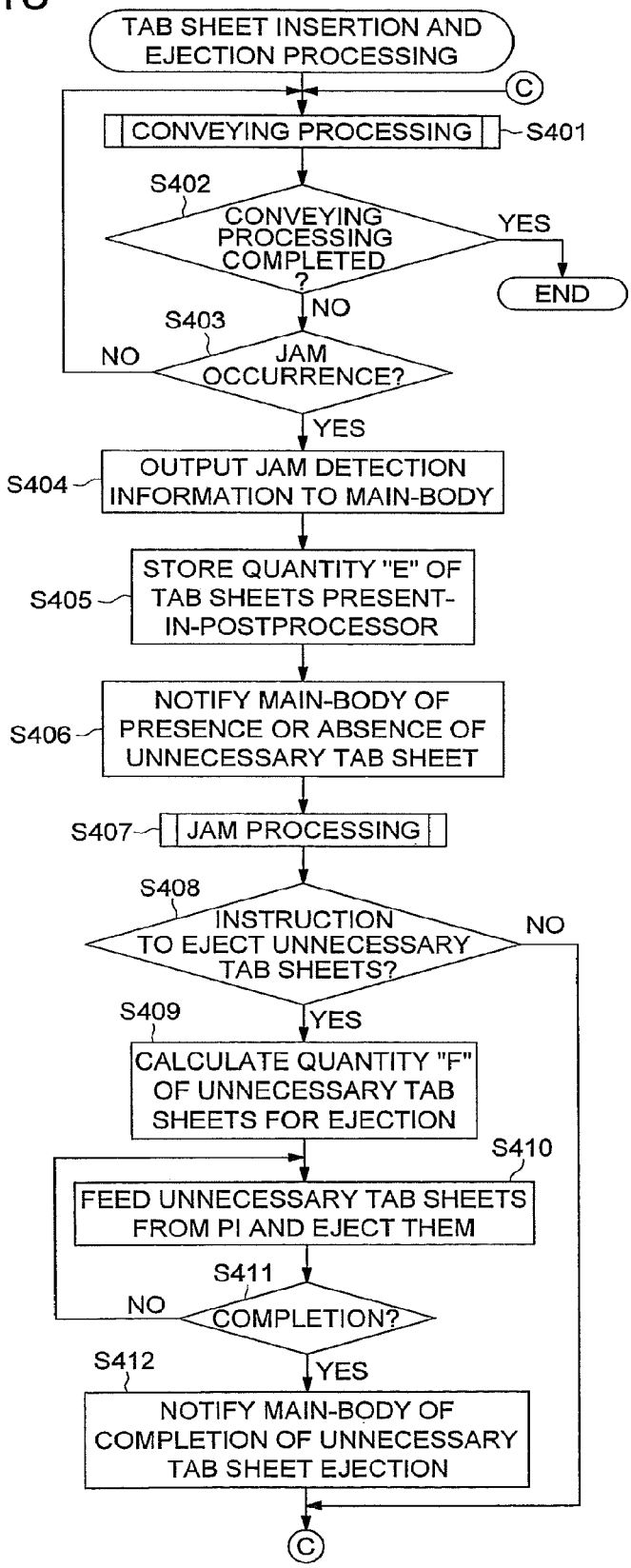
FIG. 15 is a flowchart showing a tab sheet insertion and ejection processing executed by the CPU of the post-processing control section 71 in FIG. 3.

FIG. 15 shows tab-sheet-insertion and ejection processing executed by the CPU of the post-processing control section 71. This processing is started when a notification of starting print processing is input from CPU 11, and execution of the processing realizes control means in the post-processor.

First, the conveying processing shown in FIG. 14 is performed (step S401). After the conveying processing is started, completion of the conveying processing and occurrence of jamming are monitored. If the conveying processing is completed (step S402; YES), then the present processing terminates.

If occurrence of a jam is detected during conveying processing (step S403; YES), jam detection information is output to CPU 11 of the main body 1 (step S404). Further, quantity E of tab sheets present-in-postprocessor, which is the quantity of tab sheets present in the post-processor 2, is calculated and stored (step S405). Specifically, quantity E of tab sheets present-in-postprocessor is calculated from the difference between quantity n11 of fed tab sheets and quantity n12 of ejected tab sheets and stored into RAM 13. Then, it is determined whether or not there is an unnecessary tab sheet/sheets, according to quantity E of tab sheets present-in-postprocessor, and information on whether or not there is an unnecessary tab sheet/sheets is transmitted to CPU 11 (step S406). If quantity E of tab sheets present-in-postprocessor E≠0, and quantity E of tab sheets present-in-postprocessor is not an integer multiple of quantity m1 of tab sheets per tab sheet set to be used, then it is determined that there is an unnecessary tab sheet/sheets to be ejected.

Upon input of jam detection information from the post-processing control section 71, CPU 11 of the main body 1 functions to display a jam notifying screen (not shown) notifying the occurrence and position of a jam, according to the jam detection information from the post-processing control section 71. According to this, the user performs jam processing to remove sheets present in the conveying path in the post-processor 2. If the jam is released, then the content of the information on whether or not there is an unnecessary tab sheet/sheets is determined, the information being input from the CPU of the post-processing control section 71, and if the information indicates that there is no unnecessary tab sheet to be ejected, then printing is restarted from the page which was the most front at the time of the jam occurrence. If the information indicates that there is an unnecessary tab sheet/sheets to be ejected, then the unnecessary tab sheet ejection selecting screen 201, shown in FIG. 6, is displayed on the operation display section 20. If YES button is pressed via the unnecessary-tab-sheet ejection selecting screen 201, and the start button is pressed, then instruction to eject the unnecessary tab sheets is output to the post-processing control section 71, and input, from the post-processing control section 71, of a notification of ejection completion of the unnecessary tab sheets is waited for. On the other hand, if NO button is pressed via the unnecessary-tab-sheet ejection selecting screen 201, and the start button is pressed, then instruction not to eject unnecessary tab sheets is output to the post-processing control section 71, and printing is restarted from the page which was the most front at the time of the jam occurrence.

If Jam is released by performing jam processing in the post-processor 2 (step S407) and instruction for ejection of unnecessary tab sheets is input from CPU 11 of the main body 1 (step S408; YES), then quantity F of unnecessary tab sheet for ejection is calculated (step S409). Specifically, the above described [Expression 4] calculates quantity F of unnecessary tab sheet for ejection. Then, tab sheets in the calculated quantity F are sequentially fed from PI 95 and ejected from the second ejection tray Ta2 (step S410). If the counted number of sensor signals at the time of ejection of the tab sheets to the second sheet ejection tray Ta2 reaches F, and ejection is completed (step S411; YES), then a notification of ejection completion of unnecessary tab sheet/sheets is output to CPU 11 of the main body 1 (step S412), and the processing returns to S401. On the other hand, if an instruction not to eject unnecessary tab sheet is inputted from CPU 11 of the main-body 1 (Step S408; NO), then the processing returns to step S104.

Upon input of the notification of ejection completion of unnecessary tab sheet from the post-processing control section 71, CPU 11 of the main body 1 restarts printing from the page which was the most front at the time of the jam occurrence.

If another jam occurs during ejection of unnecessary tab sheets after releasing a jam or during ejection of unnecessary tab sheets at the time of ejection completion of transfer sheets and tab sheets for one copy in conveying processing, quantity n15 of unnecessary tab sheets having been fed is obtained, and quantity G of unnecessary tab sheets to be ejected after the jamming of unnecessary tab sheets is calculated by the above described [Expression 5]. If the user performs jam processing to remove transfer sheets present in the conveying path in the post-processor 2 and presses the start button after releasing the jam, then ejection of tab sheets in quantity G is instructed from CPU 11 to the post-processing control section 71. If ejection of tab sheets in quantity G is instructed to the CPU of the post-processing control section 71, then tab sheets as unnecessary tab sheets in quantity G are sequentially fed from PI 95 and ejected from the second ejection tray Ta2. Then, sensor signals from sensor SE 18 are counted, and when the counted number reaches G, a notification of ejection completion of unnecessary tab sheets is output to CPU 11. Upon input, from the post-processing control section 71, of the notification of ejection completion of unnecessary tab sheets, CPU 11 restarts printing from the page which was the most front at the time of the jam occurrence.

As described above, in the modified example of the second embodiment, when a jam occurs in the post-processor 2, the following control can be performed. The post-processing control section 71 of the post-processor 2 obtains the quantity of tab sheets present in the post-processor at the time of the jam occurrence. If there is an unnecessary tab sheet/sheets, the quantity of unnecessary tab sheets to be ejected on the side of the post-processor 2 after releasing the jam is calculated, and then tab sheets in the calculated quantity is fed from PI 95 to be ejected from the second ejection tray Ta2.

According to the second embodiment and the modification of second embodiment, even if a jam occurs when a special sheet set is used, the set being a plurality of different kinds of special sheets disposed in a predetermined order, it is possible to eject unnecessary sheets, taking into account the quantity of the transfer sheets and the special sheets loaded on the loading unit for post-processing, and thus the order of special sheets to be used after releasing the jam is prevented from being shifted.

Also, even if a jam occurs during ejection of unnecessary sheets, it is possible to eject unnecessary sheets, taking into account the quantity of the transfer sheets and the special sheets loaded on the loading unit for post-processing, and thus the order of special sheets to be used after releasing the jam is prevented from being shifted.

Also, even if a jam occurs during printing by the use of a special sheet set mounted on the post-processor side, the set being a plurality of different kinds of special sheets disposed in a predetermined order, the order of special sheets to be fed after releasing the jam is prevented from being shifted.

Also, when occurrence of a jam is detected, if one or more special sheets having been fed are present in the post-processor, the quantity of the one or more special sheets is obtained, and it is possible to determine the quantity of unnecessary sheet or sheets to be ejected, according to the quantity of sheets per special sheet set and the quantity of the sheet or sheets which are present in the image forming system.

Also, even if a jam occurs during ejection of an unnecessary sheet or sheets, the order of special sheets to be used after releasing the jam is prevented from being shifted.

Further, in printing by the use of a special sheet set mounted on the post-processor side, the set being a plurality of different kinds of special sheets disposed in a predetermined order, wherein the quantity of a special sheet or sheets to be used for one copy is not an integer multiple of the quantity of special sheets per special sheet set, even if a jam occurs during ejection of unnecessary sheet or sheets, the order of special sheets to be fed after releasing the jam is prevented from being shifted.

Also, even if a jam occurs during printing by the use of a special sheet set mounted on the post-processor side, the set being a plurality of different kinds of special sheets disposed in a predetermined order, it is possible to eject unnecessary sheets, taking into account the quantity of the transfer sheets and the special sheets loaded on the loading unit for post-processing, and thus the order of special sheets to be used after releasing the jam is prevented from being shifted.

Preferred examples of image forming apparatus 100 in the first and second embodiments in accordance with the invention have been described above. However, the invention is not limited thereto.

The descriptions of the above embodiments have been made for cases where printing is performed using a tab sheet set of a plurality of tab sheets with different tab positions, which is an example of using a special sheet set of a plurality of different special sheets arranged in a predetermined order. However, the invention is not limited thereto and can be applied to any case in which used is a sheet set arranged with different kinds of sheets in a specific order, such as a case where printing is performed using a series of sheets in plural different colors or a series of sheets with different prints.

Further, with an image forming apparatus or an image forming system having a post-processor, in a case where transfer sheets and special sheets are loaded on a loader 96, such as an intermediate stacker, in the post-processor in order to perform post-processing (for example, side-stitching, multi folding, saddle stitching) and thereafter ejected, it is preferable that a sensor is provided near the entrance of the loader 96 and near the exit of the loader; the respective quantities of transfer sheets and tab sheets conveyed onto the loader 96 are counted; and tab sheets on the loader 96 which are not removed through jam processing at the time of ejection of unnecessary sheets and feeding of sheets after jam processing are not to be handled as sheets which are present in the image forming apparatus at the time of a jam occurrence. Thereby, even in a case of performing post-processing by the use of an intermediate stacker, proper sheet feeding can be performed after jam processing.

In the above embodiments, the printing method for the image forming apparatus 100 is an electrophotographing method. However the printing method is not limited thereto and may be an inkjet method, thermal transfer method, or any other printing method.

Still further, with respect to the detailed structure and operation of the image forming apparatus 100 and the host device 200 constructing the image forming system SY, any modifications may be made within the spirit of the invention.

What is claimed is:

1. A computer readable recording medium storing a program which causes a to control an image forming system which uses a set of a plurality of different kinds of special sheets that are disposed in a predetermined order, feeds a recording sheet or special sheet in a predetermined order, forms an image at least on the recording sheet having been fed, based on inputted image data, and ejects the fed recording sheet or special sheet, wherein the program comprises:

recognizing whether one or more special sheets having been fed are present in the image forming system, when occurrence of a jam is detected; and if it is recognized that one or more special sheets are present in the image forming system, ejecting a special sheet or sheets as unnecessary up to one that is on a special sheet feeding tray and disposed preceding a special sheet that is of the same kind as a most front one that was present in the image forming system at the time of the occurrence of the jam after the jam has been released, after the jam being released.

2. The computer readable recording medium storing the program of claim 1, wherein the program further comprises obtaining a quantity of the one or more special sheets when occurrence of a jam is detected and if it is recognized that one or more special sheets having been fed are present in the image forming system; and determining a quantity of unnecessary sheet or sheets to be ejected, according to the quantity of special sheets per set and the obtained quantity of the one or more special sheets.

3. The computer readable recording medium storing the program of claim 1, wherein the program further comprises ejecting the unnecessary sheet or sheets to an ejection tray other than one for a recording sheet on which an image has been formed or a special sheet.

4. The computer readable recording medium storing the program of claim 1, wherein the program further comprises displaying a selection screen on a display screen to select whether or not to perform ejection of the unnecessary sheet or sheets; and performing control to eject the unnecessary sheet or sheets if performing ejection of the unnecessary sheet or sheets is selected via the selection screen, and not to eject the unnecessary sheet or sheets if not-performing ejection of the unnecessary sheet or sheets is selected.

5. The computer readable recording medium storing the program of claim 1, wherein the program further comprises obtaining a quantity of the one or more special sheets when occurrence of a jam is detected during ejection of the unnecessary sheet or sheets and if it is recognized that one or more special sheets which have been fed are present in the image forming system, and performing control to eject a special sheet or sheets in a remaining quantity calculated by subtraction of the obtained quantity of the one or more special sheets from the quantity of the unnecessary sheet or sheets to be ejected after the jam is released.

6. A computer readable recording medium storing a program which causes a computer to control an image forming system which uses a set of a plurality of different kinds of special sheets that are disposed in a predetermined order, feeds a recording sheet or special sheet in a predetermined order, forms an image at least on the recording sheet having been fed, based on inputted image data, and ejects the fed recording sheet or special sheet, wherein the program comprises:

performing control to eject an unnecessary special sheet or sheets each time image forming and ejection for one copy are completed, if a quantity of special sheet or sheets to be used for one copy is not an integer multiple of the quantity of special sheets per set;

obtaining a quantity of the one or more special sheets, when occurrence of a jam is detected during ejection of the unnecessary sheet or sheets and if one or more special sheets having been fed are present in the image forming system; and performing control to eject a special sheet or sheets in a remaining quantity calculated by subtraction of the obtained quantity of the one or more special sheets from the quantity of the unnecessary sheet or sheets to be ejected, after the jam is released.

7. A computer readable recording medium storing a program which causes a computer to control an image forming system which uses a set of a plurality of different kinds of special sheets that are disposed in a predetermined order, feeds and conveys a recording sheet or special sheet in a predetermined order, forms an image at least on the recording sheet having been fed, based on inputted image data, stacks the conveyed recording sheet or special sheet onto a stacking unit for post-processing, performs post-processing when a recording sheet or sheets and a special sheet or sheets for one copy have been stacked, and ejects the sheets, wherein the program comprises:

recognizing whether one or more special sheets which have been fed are present at a place other than the stacking unit in the image forming system, when occurrence of a jam is detected; and if it is recognized that one or more special sheets are present at a place other than the stacking unit, ejecting a special sheet or sheets as unnecessary up to one that is on a special sheet feeding tray and disposed preceding a special sheet that is of the same kind as a most front one that was present at the place other than the stacking unit at the time of the occurrence of the jam, after the jam is released.

8. A computer readable recording medium storing a program which causes a computer to control an image forming system which uses a special sheet set of a plurality of different kinds of special sheets that are disposed in a predetermined order, feeds and conveys a recording sheet or special sheet in a predetermined order, forms an image at least on the recording sheet having been fed, based on inputted image data, stacks the conveyed recording sheet or special sheet onto a stacking unit for post-processing, performs post-processing when a recording sheet or sheets and a special sheet or sheets for one copy have been stacked, and ejects the sheets, wherein the program comprises:

performing control to eject an unnecessary special sheet or sheets each time image forming and ejection for one copy are completed, if a quantity of a special sheet or sheets to be used for one copy is not an integer multiple of a quantity of special sheets per set; and when occurrence of a jam is detected during ejection of the unnecessary sheet or sheets and if one or more special sheets having been fed are present at a place other than the stacking unit in the image forming system, obtaining a quantity of the one or more special sheets; and performing control, to eject a special sheet or sheets in a remaining quantity calculated by subtraction of the obtained quantity of the one or more special sheets from the quantity of the unnecessary sheet or sheets to be ejected, after the jam is released.

* * * * *